United States Patent [19]

Kolomayets et al.

[11] Patent Number: 4,714,244

[45] Date of Patent: Dec. 22, 1987

[54] ROWING MACHINE WITH IMPROVED MECHANICAL FEATURES

[75] Inventors: George Kolomayets; Allen Ryan, both of Chicago, Ill.; Augustine Nieto, Newport Beach, Calif.; Bryan Andrus, Chicago, Ill.

[73] Assignee: Bally Manufacturing Corporation, Chicago, Ill.

[21] Appl. No.: 848,705

[22] Filed: Apr. 4, 1986

[51] Int. Cl.[4] ..... A63B 69/06

[52] U.S. Cl. ..... 272/72; 272/133; 272/135

[58] Field of Search ..... 272/72, 133, 135; 242/157 R; 254/389; 273/DIG. 6

[56] References Cited

U.S. PATENT DOCUMENTS

| | | | |
|---|---|---|---|
| 1,979,716 | 11/1934 | Terry | 272/72 |
| 1,983,911 | 12/1934 | Luppert | 272/72 |
| 2,397,054 | 3/1946 | Segalla | 272/72 |
| 4,114,875 | 9/1978 | Deluty | 272/133 |
| 4,174,832 | 11/1979 | Thompson | 272/133 |
| 4,557,480 | 12/1985 | Dudley | 272/133 |

*Primary Examiner*—Leo P. Picard

*Attorney, Agent, or Firm*—Jenner & Block

[57] ABSTRACT

A rowing exercise machine having an improved user interface. The user interface has a cable for accepting user exercising stroke movements each stroke having a power and return portion. The cable is carried on a cable drum which is mounted on a shaft such that when the cable is unwound and rewound rotation to the shaft is imparted. A flywheel is connected to the shaft for receiving and conserving angular momentum imparted thereto. The machine also includes a brake for opposing the rotational displacement of the flywheel. The user interface further includes a stainless steel eye staked into one end of a strain relief spring with an end of the cable being staked in the opposite end of the spring. A handle is secured to the eye which is capable of withstanding the concentrated forces to which the user interface is subjected. A nylon cable port is mounted on the cable drum housing, the cable port having a centrally located aperture therein with cross sections which are generally oval in shape to allow the cable to be pulled out from the cable port along a line generally parallel to the base of the cabinet or at an upward angle with respect to the base without rubbing against the cable port. The cable drum has an angled sidewall to allow only one row of cable to be wound there around so as to maintain the forces opposing the user constant and controllable. The cable drum further includes a guide plate positioned between the end plates of the drum so as to lightly rub against the cable and guide it onto the drum in order to prevent tangling of the cable if it is not rewound fast enough.

8 Claims, 26 Drawing Figures

FIG. 14A
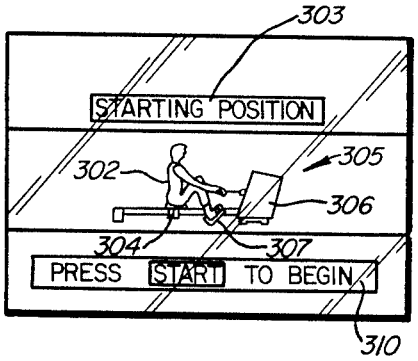
FIG. 14B
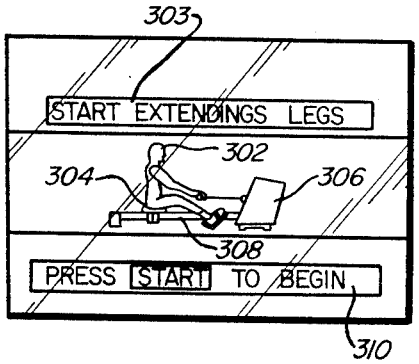
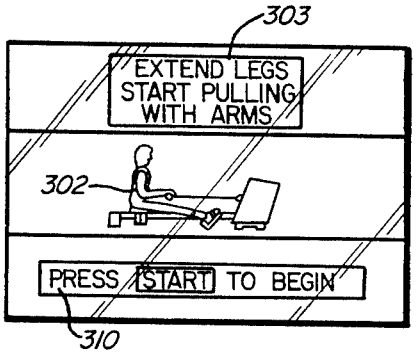
FIG. 14C
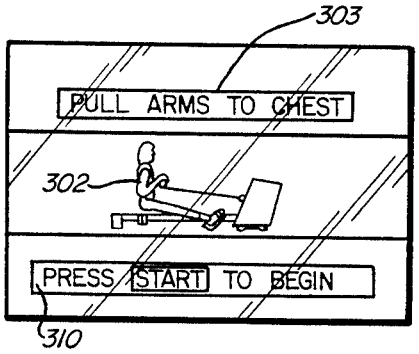
FIG. 14D

FIG. 20
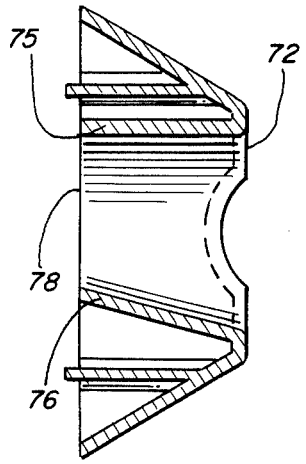
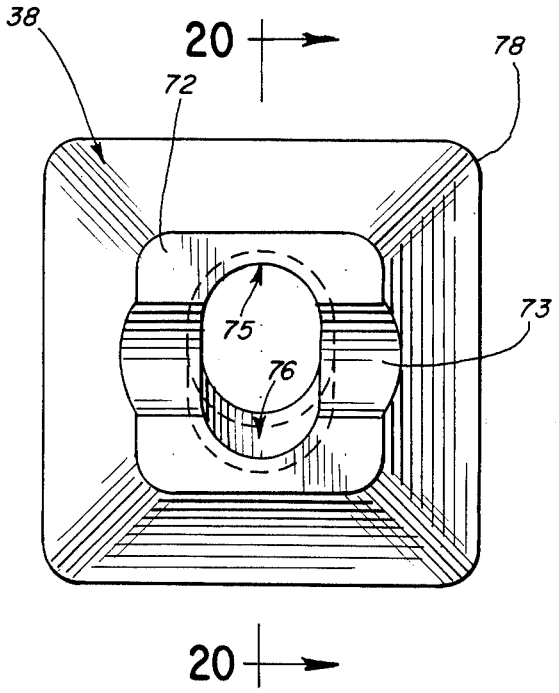
FIG. 21
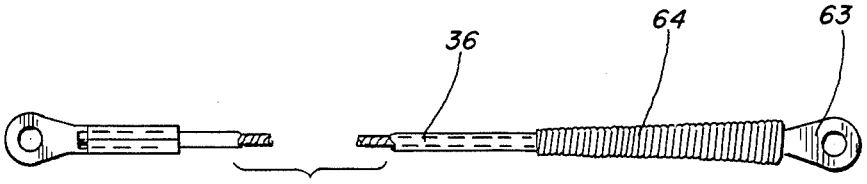
FIG. 22

ROWING MACHINE WITH IMPROVED MECHANICAL FEATURES

TECHNICAL FIELD

The present invention relates to a rowing exercise machine and more particularly to such a machine with an improved user interface and means for coupling the interface to the mechanism which provides the force opposing the user.

BACKGROUND OF THE INVENTION

The sport of rowing has long been recognized as providing an excellent form of exercise. A rower can thoroughly exercise and develop his or her legs, back, shoulders, arms and other areas of the body. However no jarring or pounding effect is imparted to the rower's knees or other body parts, as may occur in other sports such as running.

An exemplary rowing exercise machine, providing the benefits of the sport of rowing, is disclosed in U.S patent application Ser. No. 762,709 filed Aug. 5, 1985. In this rowing exercise machine, a user interface, including a cable having a handle attached thereto for engagement by the user is unwound and rewound about a cable drum to impart rotation to a shaft on which the drum is mounted. Connected to the shaft is a flywheel for receiving and conserving angular momentum imparted to the shaft. A brake unit is coupled to the shaft to resist rotation of the shaft during the power portion of a stroke to thereby provide a force opposing the user. One problem encountered with this type of rowing machine is the wear on the user interface cable fittings caused by concentrated forces produced by the user and the mechanism opposing the user. The cable port through which the cable exits the cabinet housing the cable drum, flywheel, etc., is also subject to considerable wear. Further problems have arisen when the cable is rewound wherein the cable falls off the drum or loops and gets tangled if the rewinding is not fast enough.

SUMMARY OF THE INVENTION

In accordance with the present invention the disadvantages of prior rowing exercise machines as discussed above have been overcome. The rowing exercise machine of the present invention includes an improved user interface and means coupling the interface to the mechanism which provides the force opposing the user.

More particularly, the present invention is directed to a rowing exercise machine such as disclosed in U.S. patent application Ser. No. 762,709 filed Aug. 5, 1985 with an improved user interface in which a stainless steel eye staked into one end of a strain relief spring is used to couple a handle to the cable, an end of which is staked into the opposite end of the strain relief spring. This fitting has been found to withstand the forces to which it is subjected under normal use of the exercise rowing machine.

An improved cable port on the cabinet housing the drum is also provided wherein the cable extends from the drum through the port to the handle. The cable port has the general shape of a truncated pyramid with its face secured to the cabinet and its top having a centrally located aperture therein with cross sections which are generally oval in shape but of varying circumference. The aperture has sidewall portions positioned in planes with respect to the cabinet base to guide the cable out of the cable port along a line generally parallel to the base of the cabinet and to the flooring on which the rowing machine is mounted; or at an upward angle with respect to the cabinet base and floor. The cable port, so configured allows a user to pull the cable straight out from the cabinet or to pull it at an upward angle without rubbing the cable against the cable port. The aperture thus prevents wear on the port.

In order to prevent the cable from being tangled during the rewinding operation, a guide plate is positioned between two end plates of the drum so as to lightly rub against the cable and guide it onto the drum. The cable drum is also configured with a sidewall which is angled with respect to a line perpendicular to the drum's end plates such that the circumference of the drum adjacent one end plate is less than the circumference of the drum adjacent the opposite end.

These and other objects and advantages of the invention, as well as details of an illustrative embodiment, will be more fully understood from the following description and the drawings.

BRIEF DESCRIPTION OF THE DRAWINGS

FIGS. 14A–D illustrates successive frames shown on the video display monitor of the rowing machine to instruct a user;

FIG. 20 is a side view of the cable port of the present invention;

FIG. 21 is a front view of the cable port of FIG. 21; and

FIG. 22 is a perspective view of a cable fitting shown coupled to a portion of cable.

BEST MODE FOR CARRYING OUT THE INVENTION

Figure 1:
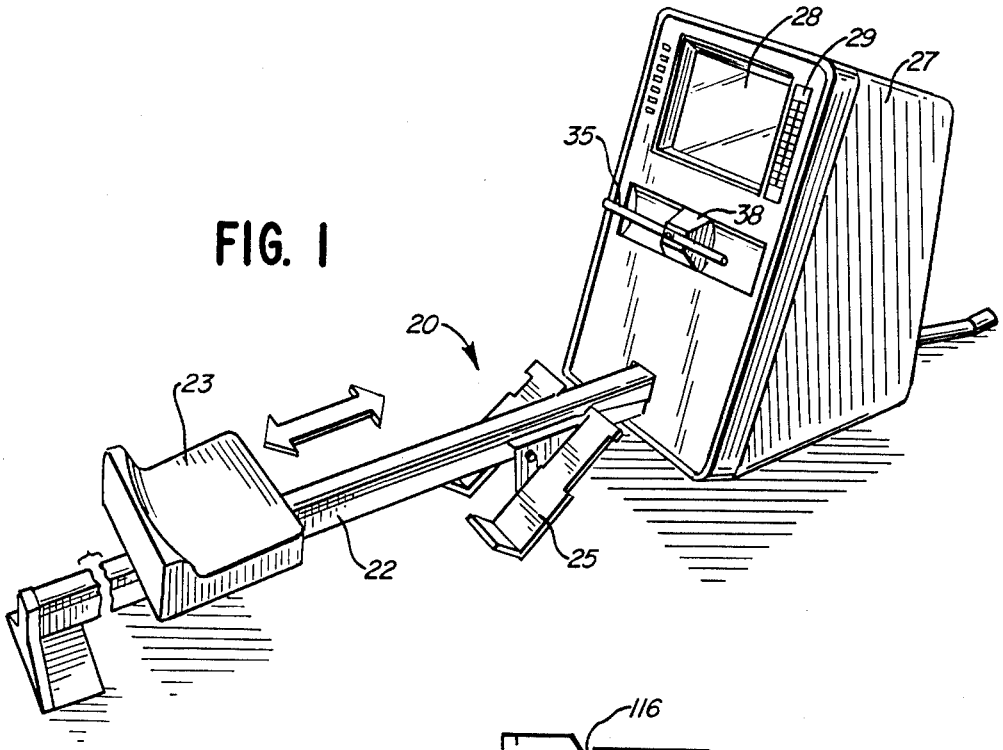
FIG. 1 is a perspective view of the rowing exercise machine of the present invention.

The rowing exercise machine 20 of the present invention, as shown in FIG. 1, includes an elongated rail 22, upon which a seat 23 is mounted. A roller assembly (not shown) permits the seat to move back and forth in a reciprocal manner along the rail 22. If desired, a foot arrangement can be provided at one end of the rail so as to support the rail 22 in a generally level position slightly above the floor on which the rowing machine 20 is placed.

An opposite end of the rail 22 is supported within the lower portions of a cabinet or housing structure 27. The cabinet 27 houses a video display monitor 28 for displaying video graphics as discussed in detail below. The cabinet 27 also houses a speaker to provide sounds which accompany the video graphics. A user input control panel 29 is also provided on the cabinet 27 to allow a user to select the duration of an exercise, its difficulty level and to create his or her own exercise program. The input control panel may be a keyboard, touch screen or the like with keys or touch areas bearing various alphanumeric indicia.

Figure 2:
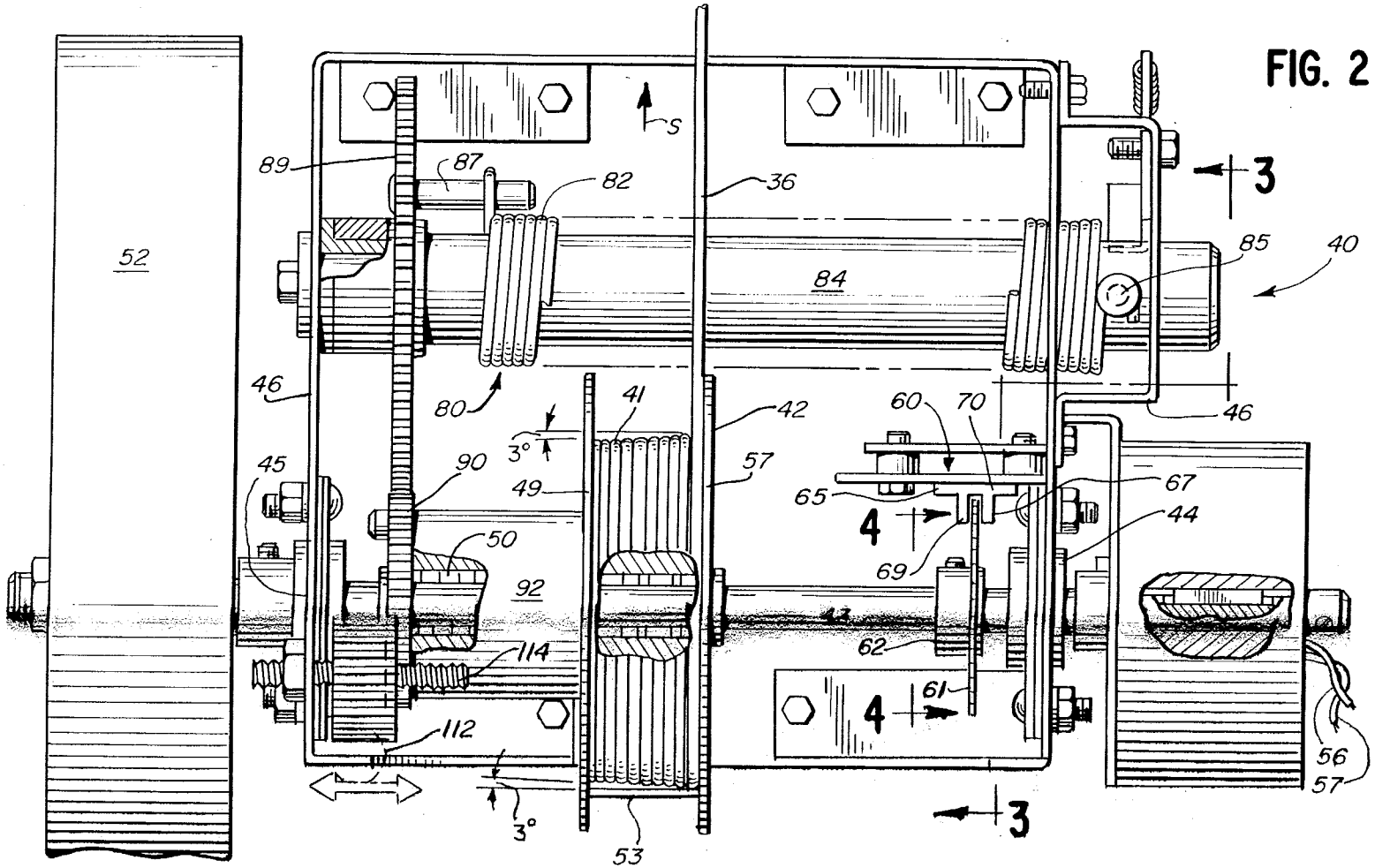
FIG. 2 is a top plan view of a mechanical control unit contained within a cabinet of the machine.
Figure 3:
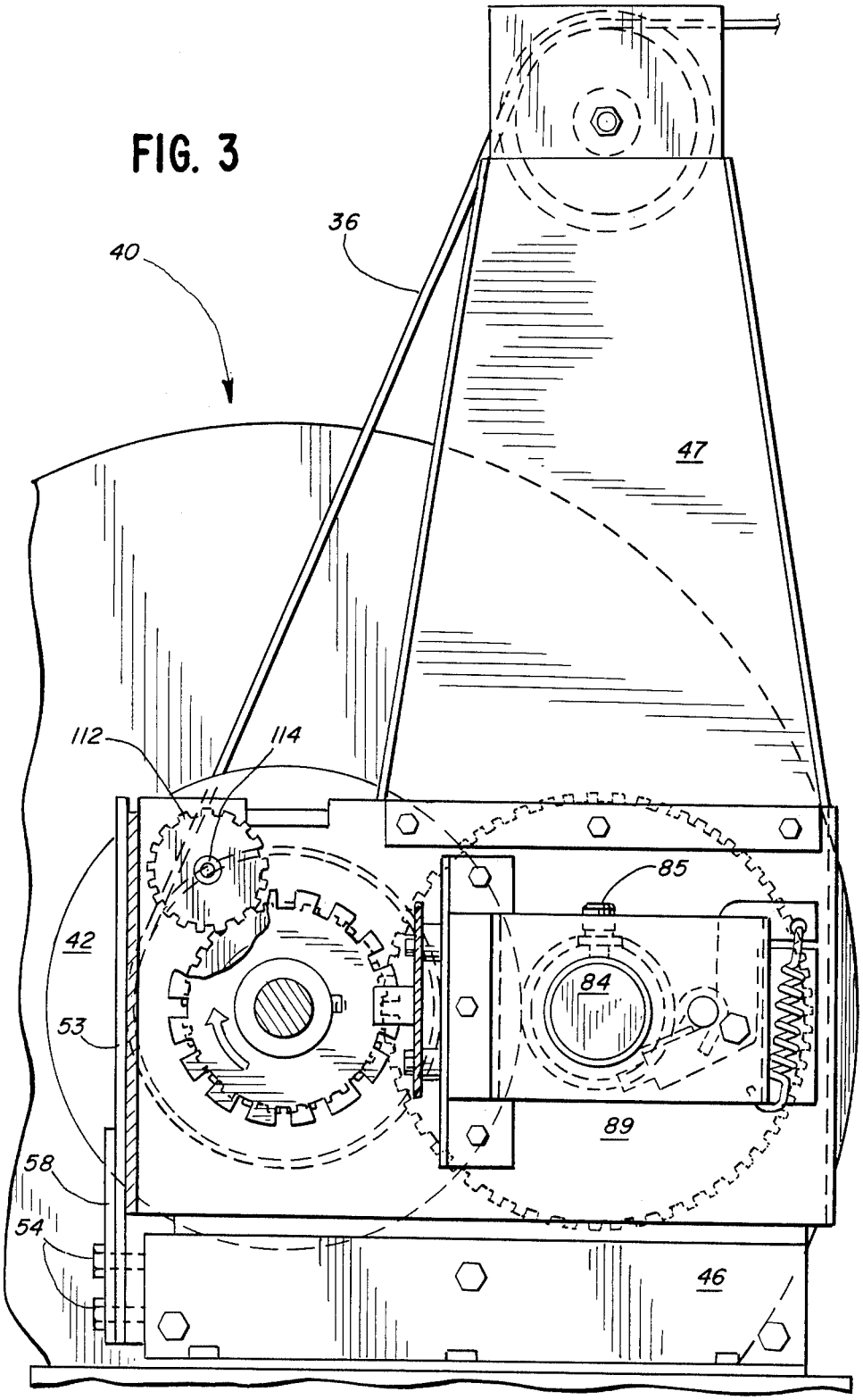
FIG. 3 is a sectional view taken substantially along the lines 3—3 of FIG. 2.

An exercise handle 35 is connected to a flexible cable 36 (FIG. 2). The cable 36 can be pulled from and drawn at least partially back into the cabinet 27 through a cable port 38. To use the machine, an individual sits upon the seat 23 and braces his feet on a foot rest assembly 25. He then grasps the handle 35 with both hands, and pulls the handle 35 and cable 36 toward himself. While doing so, he extends his legs, thereby moving the seat 23 along the rail in a direction away from the cabinet 27. This motion will be referred to as the power portion of a stroke.

At the end of the power portion of a stroke, the user releases pressure on the cable, and a mechanism, described below, within the cabinet 27 retracts the cable 36, thereby drawing the handle 35 back toward the cabinet 27. This will be referred to as the return portion of a stroke. Because the user maintains his grip upon the handle 35 during the return portion of the stroke, his legs are drawn into a flexed position, his arms are extended, and the seat 23 is drawn along the rail 22 toward the cabinet 27. When the cable 36 has been retracted at least partly into the cabinet 27, the user may begin another exercise cycle.

Figure 4:
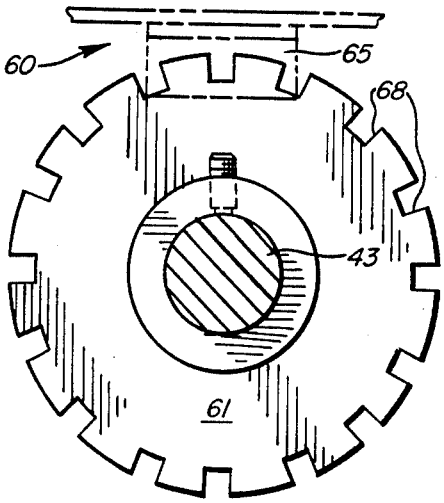
FIG. 4 is a sectional view taken substantially along the lines 4—4 of FIG. 2.
Figure 5:
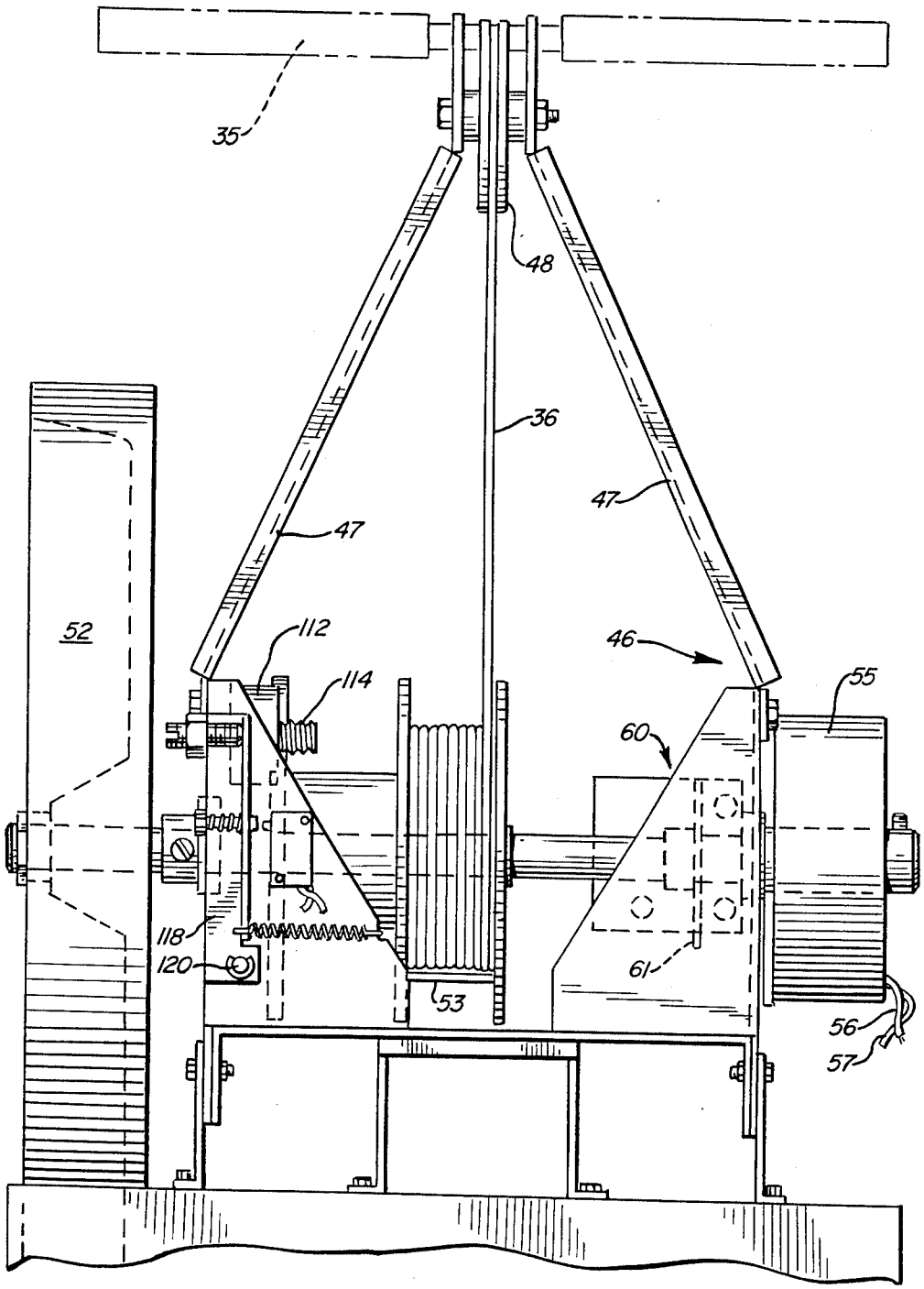
FIG. 5 is a front elevational view of the unit shown in FIG. 2.

A unit 40 for converting the motion of the cable 36 and handle 35 into flywheel rotation is shown in further detail in FIGS. 2–6. As shown especially in FIG. 2, the cable 36 is wound about a cable drum 42 carried by a master shaft 43 affixed to which is a flywheel 52. The master shaft 43 is journaled by bearings 44 and 45 to a frame 46; the frame 46 can be secured within the cabinet 27 by mounting bolts or other convenient devices. As shown in FIG. 5, the frame can include a superstructure 47 mounting a pulley 48 over which the cable 36 is routed for connection to the handle 35.

The sidewall 41 of the cable drum 42 is angled with respect to the end plates 49 and 51 of the drum such that the circumference of the drum adjacent the end plate 49 is less than the circumference of the drum adjacent the end plate 51. More particularly the sidewall 41 has a 3° angle with respect to a line which is perpendicular to the planes of the end plates 49 and 51. The angled sidewall of the drum ensures that only a single row of the cable 36 will be wound about the cable drum 42 to provide a constant force the magnitude of which can be controlled to oppose the user. If more than one row of cable 36 is allowed to be wound about the drum 42, the effective diameter of the drum would be different for each row thus varying the forces opposing the user in an undesired manner.

When the cable 36 is drawn off the drum 42 during the power position of a stroke (as indicated by the arrow S in FIG. 2), the drum 42 and shaft 43 rotate together imparting rotation to the flywheel 52 which acts as a reservoir of angular momentum. When, however, the cable 36 is rewound on the drum 42 in the return direction, the drum 42 and shaft 43 do not rotate together; this independence of motion is provided through a one-way clutch mechanism 50 which can be a sprag-type clutch or other design.

In order to slow down or stop the motion of the flywheel 52 during the return position of the stroke, a brake unit 55 is connected to the end of the master shaft 43 opposite the flywheel. The brake may be used to merely retard the motion of the flywheel to simulate the natural decrease in speed of a boat whose oarsman has stopped rowing; or the brake may be used to stop or essentially stop the flywheel motion so that on each power stroke the user has to overcome substantially the same inertia of the flywheel. The amount of braking force applied is controlled by a microprocessor, described below. The effect of the brake is independent of the angular or rotational speed of the shaft 43. To these ends, the brake unit 55 used in the preferred embodiment is a magnetic particle brake which applies a constant torque independent of rotational velocity. Extending from the brake 55 are wires 56, 57. The amount of force applied by the brake 55 to the shaft 43 is directly proportional to the current flowing through the wires 56, 57. The current applied to these wires is controlled by the electronic circuitry described below. One commercially available magnetic power brake is the Model B-5 brake offered by Magnetic Power Systems, Inc. of Fenton, Mo.

Because of the large concentrated forces applied by a user, and the rowing machine mechanism opposing the user, on the cable and in particular on the fitting which connects the cable 36 to the handle 35, a fitting 59 is employed, as shown in FIG. 22, which has a stainless steel eye 63 staked into one end of a strain releif spring 64 into the other end of which is staked an end of the cable 36. The steel eye 63 is secured to the handle 35 and has been found capable of withstanding the forces concentrated at point 66 under normal use of the rowing machine. The opposite end of the cable 36 is staked into a second eye 71 which is secured to the drum 42.

Further, to withstand wear caused by the cable 36, the cable port 38 is made of nylon and configured as shown in FIGS. 20 and 21. The cable port 38 is in the shape of a truncated four sided pyramid whose base 78 is secured to the cabinet and whose top 72 has an elongated indentation 73 to accommodate the handle 35 when the cable 36 is completely retracted into the cabinet 27. The port 38 has a centrally located aperture 74 therein through which the cable 36 is pulled in and out from the cabinet. The aperture 74 has cross section which are generally oval in shape, the length of the aperture being greater than its width. The circumference of the aperture cross sections further decreases as the cross sections are taken from the top 72 to the base 78. An upper portion 75 of the aperture sidewall is substantially perpendicular to the plane of the top 72 whereas a lower portion 76 of the sidewall is angled with respect to the plane of top 72. Because the front of the cabinet 27 is angled as shown in FIG. 1, when the port 38 is secured thereto the aperture sidewall portion 36 lies generally parallel to the ground or floor on which the machine stands and the sidewall portion 75 angles up with respect to the portion 76. This is to reduce wear on the cable port 38 by users who do not pull the cable straight out from the port along a line generally parallel to the floor but who pull the cable at an upward angle.

The angular velocity of the shaft 43 is sensed or detected by an optical detecting device 60 as shown in FIGS. 2 and 4. The detecting device 60 takes the form of a notched wheel 61 affixed to the shaft 43 by a collar 62. An optical sensing unit 65 is mounted to a portion of the frame 46 at a convenient location to surround the periphery of the wheel 61. A light emitter 67 continuously emits light. As the light from the emitter passes through the notches 68 in the wheel 61 it is sensed by a light sensor 69. The sensor 69 emits an electrical signal which is transmitted to other parts of the system through a wire 70.

In carrying out the invention, the cable 36 is automatically rewound on the drum 42 during the return portion of a stroke. To this end, a cable rewind mechanism 80 is also mounted on the frame 46. Here, this rewind device 80 takes the form of a coil spring 82 which fits over a stationary shaft-like mount 84. One end of the coil spring 82 is affixed, as by a bolt 85, to the shaft 84. The other end 87 of the coil spring 82 is attached by a mounting pin 88 or other convenient device to a rotatable rewind gear 89.

The rewind gear 89 meshes with a smaller drive gear 90 which is mounted on an extension 92 of the cable drum 42. Thus, as the cable 36 is drawn away from the drum 42 in the direction S during the power portion of a stroke, the drum 42 rotates, and with it rotates the gear 90. The rotation of gear 90 causes rotation of the rewind gear 89, and consequently a winding action is imparted to the spring 82. When the force on the cable 36 is released, the spring 82 unwinds itself, thereby driving the gears 89 and 90, and rewinding the cable 36 on the cable drum 42. While the cable rewinding action is occurring, the one-way clutch 50 is disengaged, and the master shaft 43 and flywheel 52 continue to spin in the direction imparted by the power stroke motion with the brake 55 opposing the motion.

The cable drum 42 is provided with a nylon guide plate 53 positioned between the end plates 49 and 51 to lightly rub against the cable 36 and guide it onto the drum as the cable is rewound so that if the cable is not rewound fast enough it does not slip off the drum or loop and get tangled in other parts of the machine. As shown more particularly in FIG. 3, the guide plate 53 is secured to the frame 46 by a pair of screws 54, mounting bolts or the like and a steel bracket 58.

As explained below, it is important to electrically indicate that a power stroke has been initiated. To this end, a beginning-of-stroke detecting and signalling mechanism 110 is provided. Specifically, the mechanism 110 comprises a pinion gear 112 of relatively elongated axial extent, as shown particularly in FIGS. 2, 3, 5 and 6. This pinion gear 112 meshes with the rewind gear 90, and so rotation of the cable drum 42 rotates the meshed gear 112 in a well-known manner.

The pinion gear 112 is provided with a threaded interior hub to mate with the threads formed on a mounting stubshaft 114. The stubshaft 114 can be a common machine bolt. Thus, as the gear 112 is rotated by the rewind gear 90, the pinion gear 112 moves axially, as shown in FIGS. 2 and 6.

Figure 6:
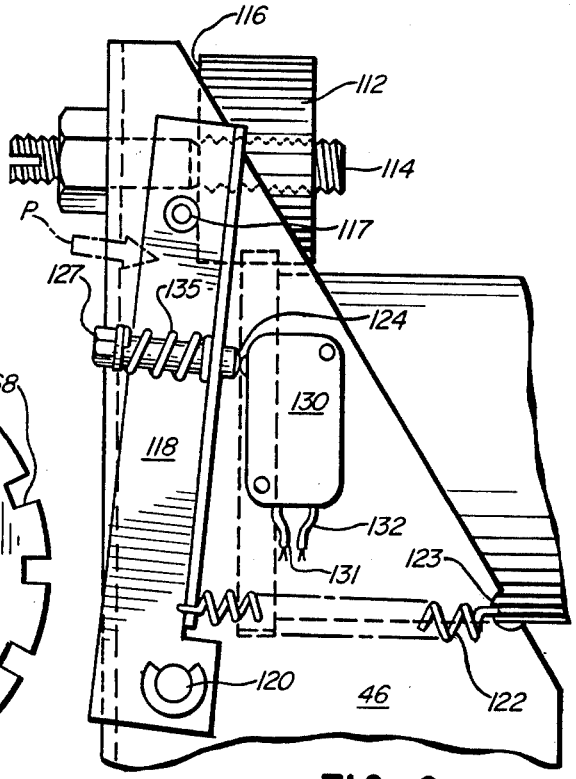
FIG. 6 is a fragmentary elevational view of a beginning-of-stroke indicator mechanism included in the mechanical control unit of FIG. 2.

An end 116 of the gear 112 is engaged by a cam-following finger 117 which is mounted upon a lever 118, as especially shown in FIG. 6. This lever 118 is pivotally mounted on the frame 46 as by a mounting pin 120 of known design. The cam-following finger 117 is caused to closely follow the axial motion of the gear surface 116 as the gear 112 turns because a spring 122 is connected between a stationary portion 123 of the frame 46 and the pivotable lever 118. Thus, when the gear 112 is helically rotated along the stubshaft 118 by the motion of the meshing gear 89, the lever 118 is caused to pivot as shown by the arrow P, FIG. 6.

Mounted to the pivotable lever 118 is an adjustable contact stop or pin 127. This pin 127 is disposed so as to contact the actuating finger 128 of a microswitch 130. Leads 131 and 132 extend from the microswitch for connection to other parts of the electrical system as described below. If desired, the contact pin 127 can be resiliently mounted as by a spring arrangement 135, so as to avoid overstressing the switch contact finger 128. Thus, as the cable 36 is withdrawn from the drum 42, the gears 90 and 112 rotate and the lever 118 pivots. The lever pivot motion causes the pin 127 to operate the microswitch 130 and signal the beginning of a power stroke. The pin 127 is adjustable so that differing cable lengths can be pulled out before the switch 130 is actuated. In the preferred embodiment, the pin is set so that the switch is actuated when approximately two feet of cable have been pulled out.

In summary, the unit 40 provides two electrical signals: the angular velocity signal on line 70 and the beginning of stroke signal on lines 131 and 132 from the switch 130. The unit 40, and in particular the brake unit 55, receives an electrical signal on lines 56 and 57. The signals to and from the unit 40 are coupled to the electrical system discussed below.

Figure 7:
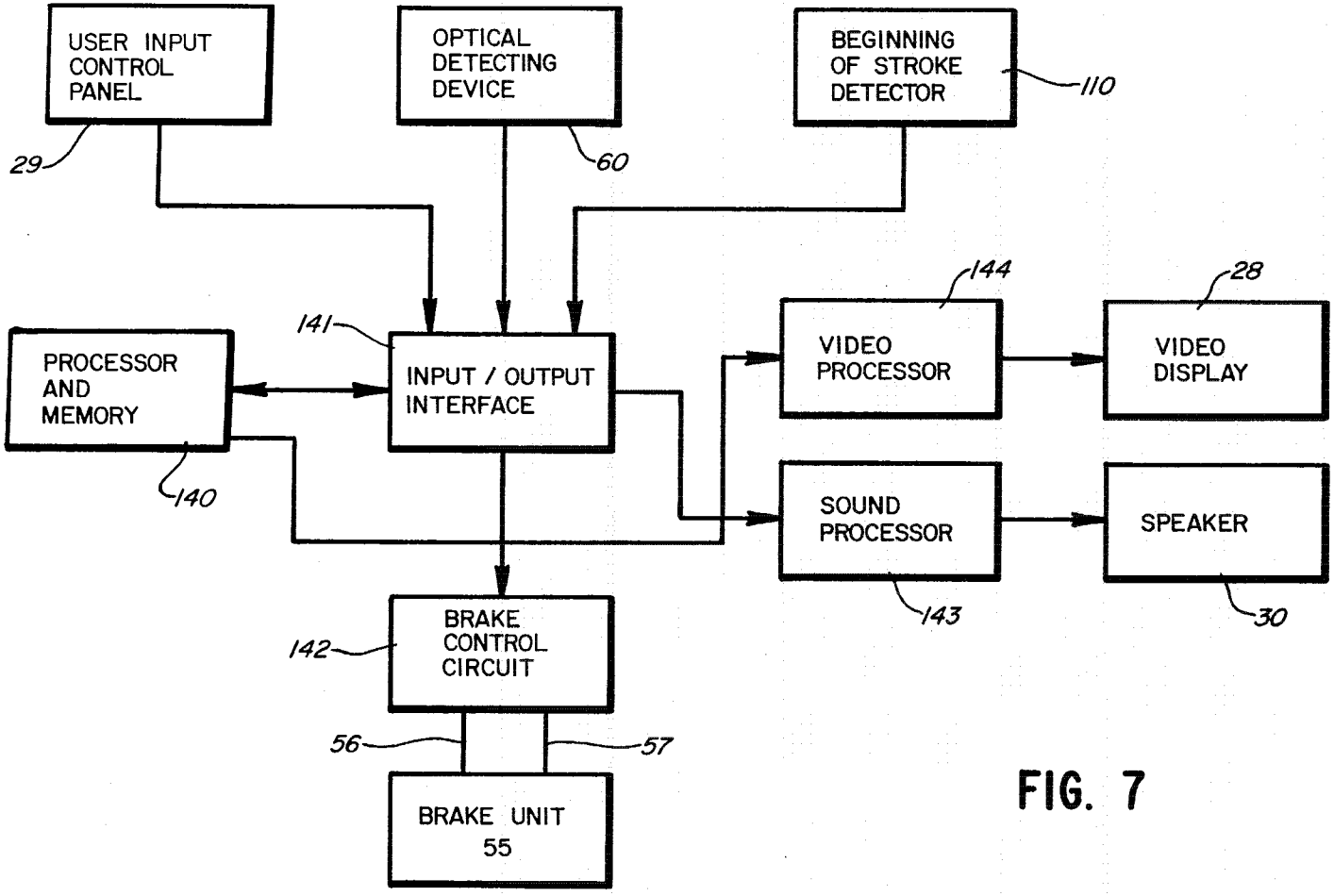
FIG. 7 is a block diagram of the computer control system of the present invention.

As shown in the block diagram of FIG. 7, signals from the optical detecting device 60, the beginning of stroke detector 130, and the input control panel 29 are coupled to a microprocessor and memory unit 140 through an input/output interface 141. The microprocessor, under the control of software contained in the memory, operates on the received data to provide output signals to control the brake unit 55, the video display 28 and the speaker 30. The output signals for the video display 28 are further processed by a video processor 144 before being sent to the display. Likewise, a sound processor 143 converts the speaker data from the processor to an analog signal for transmission to the speaker 30. The output signals controlling the brake are applied to a brake control circuit 142 which provides an analog signal to the brake unit 55.

The microprocessor and memory unit 140, the input/output interface 141, the video processor 144, the sound processor 143 and the brake control circuit 142 perform three main functions; namely, (1) receiving and processing the information entered by the user via the input control panel 29, (2) monitoring the angular velocity of the shaft 43 and controlling its velocity through the brake 55, and (3) providing the appropriate video and audio signals to the video monitor 28 and the speaker 30. Each of the electronic control circuit blocks shown in FIG. 7 are shown in more detail in FIGS. 8–12.

Figure 8:
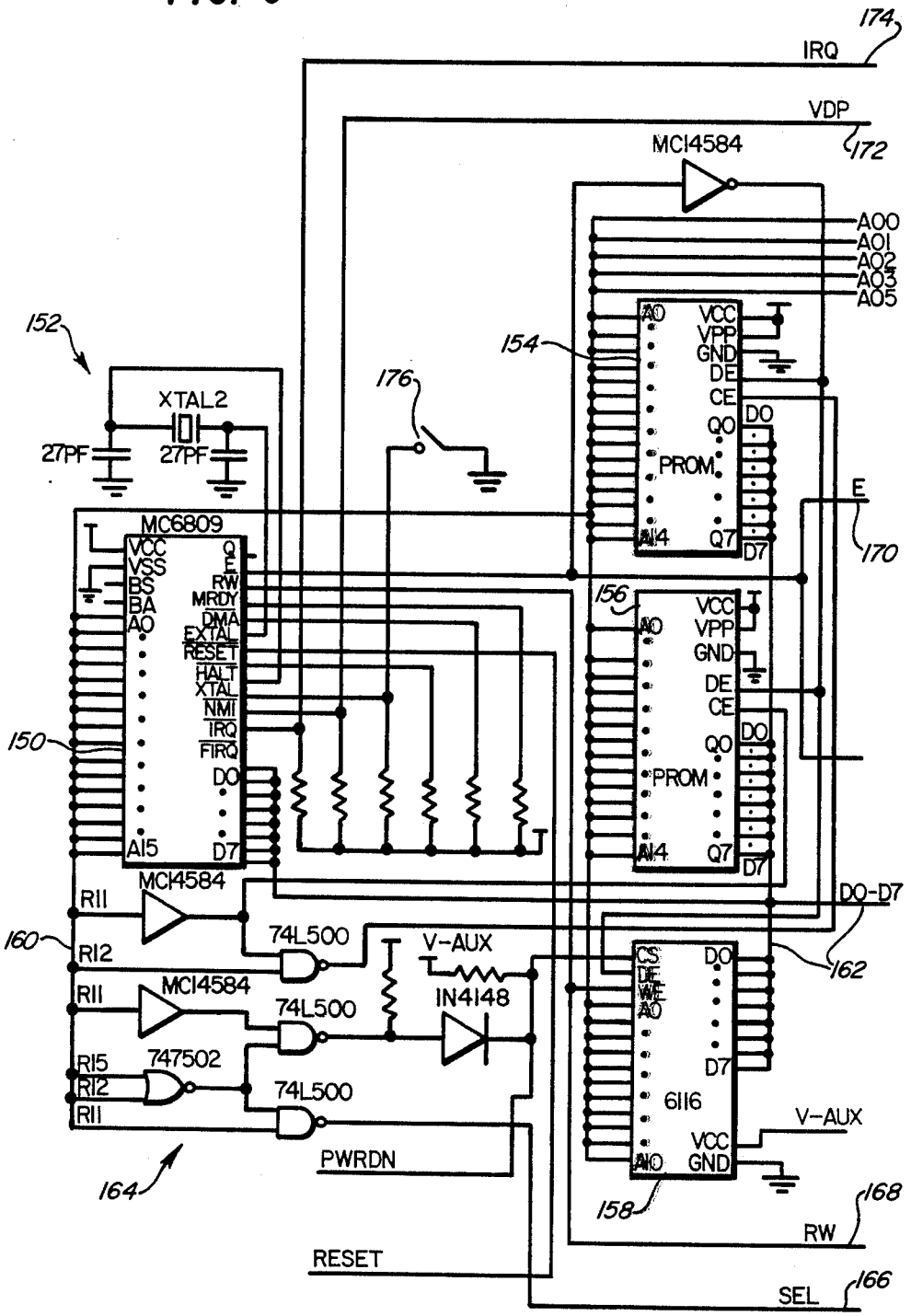
FIG. 8 is a schematic diagram of the microprocessor and memory shown in FIG. 7.

FIG. 8 illustrates the microprocessor and memory unit 140. The microprocessor 150 may be a Motorola 6809 microprocessor. A crystal oscillator circuit 152 provides a clock input to the microprocessor 150. The software program for the microprocessor is stored in read only memories, ROMs, 154 and 156. The ROMs 154 and 156 also store information utilized by the video and sound processors 144 and 143. For example, shape and color information for various graphics displayed on the monitor are stored in the ROMs 154 and 156. Other memory storage means for the microprocessor is provided by a random access memory, RAM, 158. The microprocessor communicates with the memories by an address bus 160 and a data bus 162. The data bus 162 as well as certain lines of the address bus 160 is also used to communicate with other circuitry as will be described below.

Address decode circuitry 164 is used to select and enable the memories 154, 156 and 158 when the address bus 160 contains the appropriate address. In addition, the address decode circuitry provides the select signal, SEL, 166 to enable the input/output interface circuitry 141 and the video processor 144. The microprocessor provides a read/write signal, RW, 168 to control the direction of data transfer on the data bus 162. The microprocessor provides a timing enable signal, E, 170 to indicate its machine state. Interrupt Request and Video Display Process signals, IRQ and VDP, 172 and 174 interrupt the microprocessor 150 when the input/output interface circuitry 141 or the video processor 144 wishes to transfer data to or receive data from the microprocessor 150 on the data bus 162.

Figure 9:
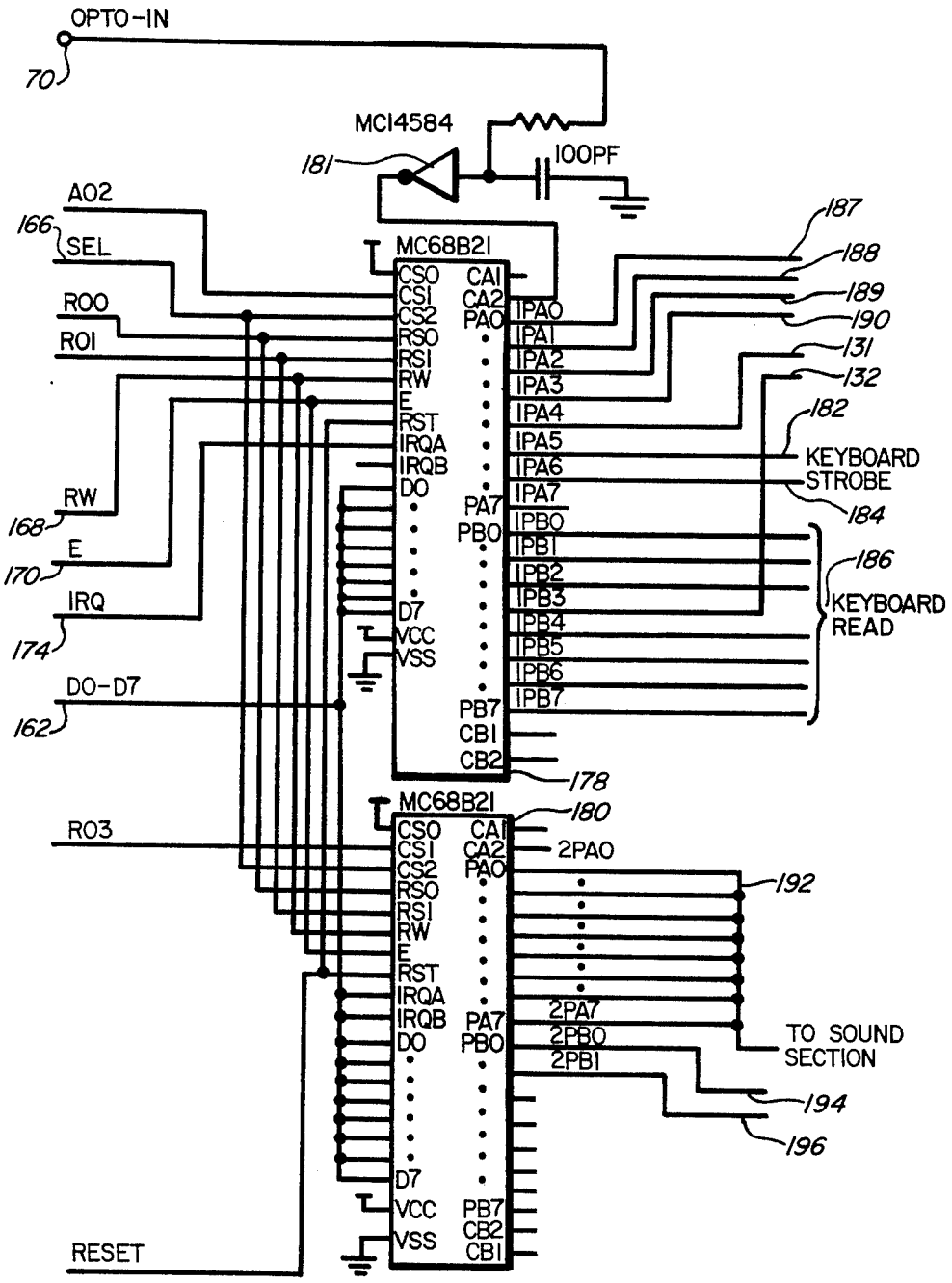
FIG. 9 is a schematic diagram of the input/output interface shown in FIG. 7.

In FIG. 9, the input/output interface 141 is illustrated. The input/output interface consists solely of two peripheral interface adaptors, PIA, 178 and 180. The PIAs are used to interface the data bus 162 with peripheral devices as illustrated in FIG. 7. PIA 178 receives data from the input control panel 29. Lines 182 and 184 are used as strobe lines, and the seven lines represented by reference number 186 are used to sense or read the data input on the control panel 29 to determine whether a particular key is actuated. The input control panel can be arranged in a 2×7 matrix, providing for fourteen different keys, i.e., "Start," "Enter," "Yes," "No" and the numerals "0–9."

Lines 131 and 132 are connected to the beginning-of-stroke detector switch 130 to determine whether the switch is actuated. Line 132 is a strobe line and line 132 is a read line. Lines 187 and 190 are outputs from PIA 178. These lines provide signals which are used by the brake control circuit 142 (see FIG. 12) to control the amount of force provided by the brake 55. Line 70 is the input from the optical sensing unit 65 and in particular from the sensor 69. This signal passes through a schmidt trigger inverter 181 to the PIA 178. PIA 180 provides an output to the sound processor 143 (see FIG. 11) on a data bus 192.

The microprocessor 150 controls the flow of data to and from the PIA's 178 and 180 on data bus 162 by the read/write control line 168, the enable timing signal 170, and the select signal 166 (FIGS. 8 and 9). The address lines A00 to A03 are used to select the desired register (A or B) within PIA's 178 and 180. PIA 178 uses interrupt request line, IRQ, 174 to notify the microprocessor 150 that data has been received from a peripheral device and is available for transfer to the microprocessor.

Figure 10:
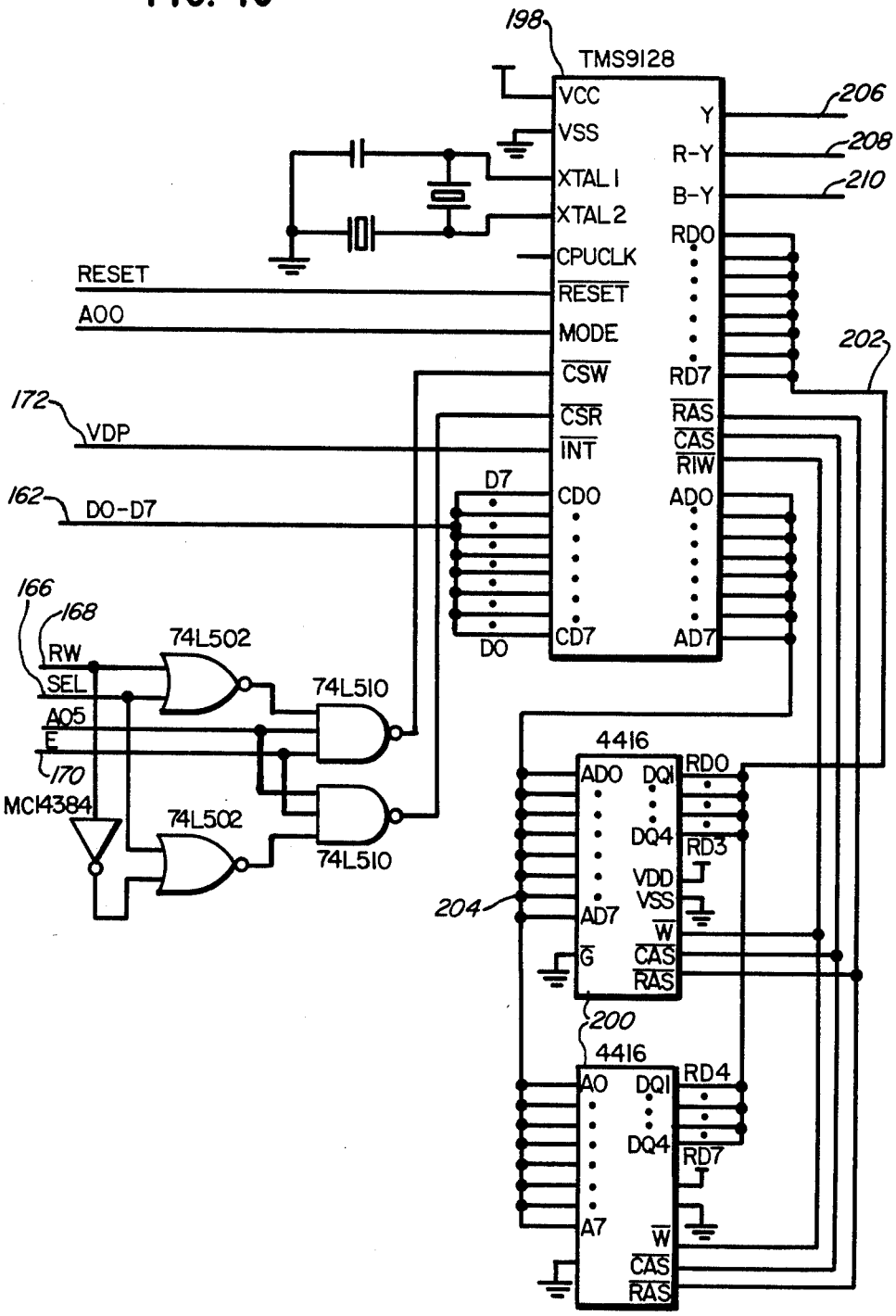
FIG. 10 is a schematic diagram of the video processor shown in FIG. 7.

FIG. 10 illustrates the video processor circuitry 144. This circuitry 144 transforms the data on data bus 162 to a form which can be used by the video monitor 28. The circuitry 144 may include a Texas Instruments video display processor 198 and associated video RAM 200. The video processor interrupts the microprocessor by providing a signal on VDP line 172. The microprocessor controls the flow of data on the data bus 162 by the read/write line 168, the select line 166, the timing enable line 170 and the address lines A00 and A05. A data bus 202 is used to transfer data between the video display processor 198 and the video RAM 200. The video display processor 198 addresses the video RAM 200 through an address bus 204. The luminance and composite sync signal (Y), the red color difference signal (R-Y) and the blue color difference signal (B-Y) are provided by the video display processor on lines 206, 208 and 210 respectively. These signals are decoded into red, blue, green and sync signals (by conventional circuitry not shown) to drive the video monitor 28.

Figure 11:
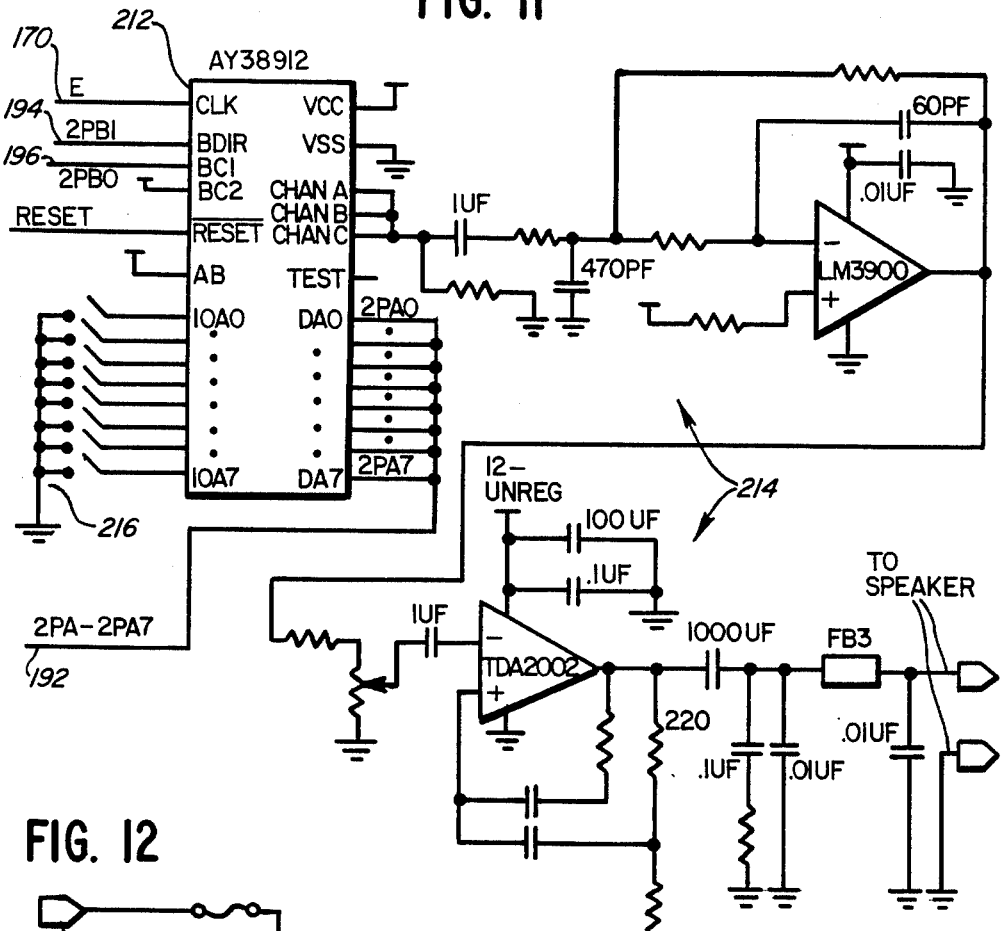
FIG. 11 is a schematic diagram of the sound processor shown in FIG. 7.

FIG. 11 shows the sound processor circuitry which decodes the data received from PIA 180 on data bus 192 into an audio signal used to drive the speaker 30. A General Instruments sound chip 212 is used to decode the data on the data bus 192. Analog circuitry 214 amplifies and filters the signal from the sound chip 212 before it is supplied to the speaker 30. The sound chip 212 is also used to transfer the state of a switch 216 to the PIA 180 for relay to the microprocessor 150. The switch 216 controls, for example, the maximum rowing time of the machine. Lines 194 and 196 are used to control the flow of data between PIA 180 and the sound chip 212.

Figure 12:
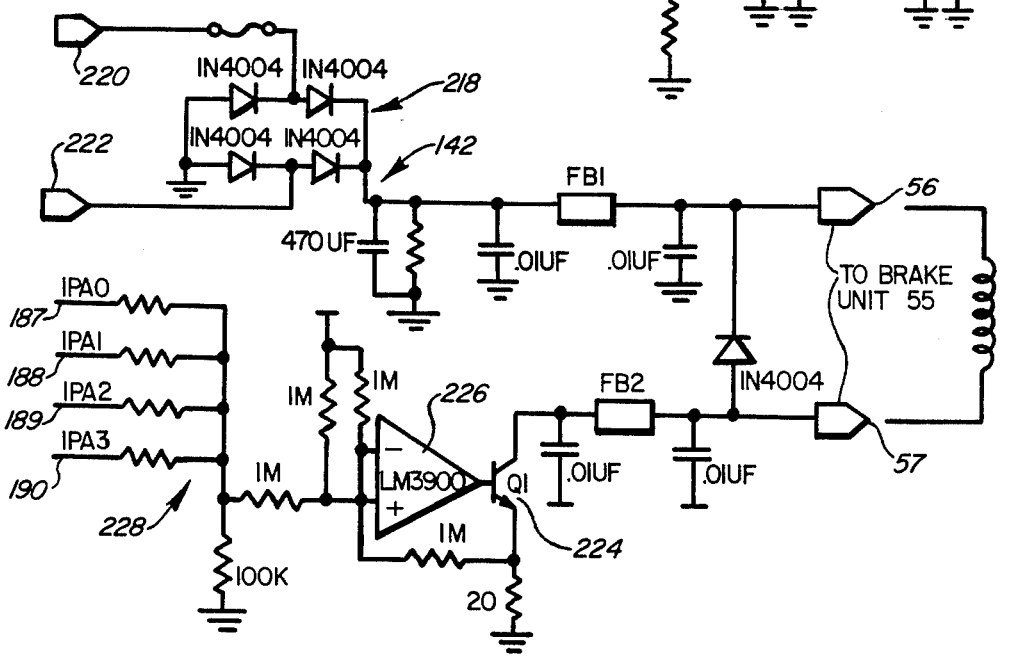
FIG. 12 is a schematic diagram of the brake control circuitry shown in FIG. 7.

FIG. 12 illustrates the brake control circuitry 142. As can be seen, a rectifier circuit 218 rectifies an AC voltage (supplied on two lines 220 and 222) to a DC voltage. The AC voltage supplied on lines 220 and 222 is such that the DC voltage present between lines 56 and 57 is equal to the voltage needed to make the brake 55 operate properly. For the magnetic brake previously mentioned, this voltage is approximately 90 VDC.

In order to control the amount of force applied by the brake, the current to the brake is controlled by a transistor 224. The base of the transistor is coupled to the output of an operational amplifier 226, the noninverting input of which is connected to voltage divider network 228. Since the brake is connected between leads 56 and 57 and thus acts as an inductor to the circuit shown in FIG. 12, the voltage divider network 228, operational amplifier 226 and the transistor 224 act as a current source for the brake which is controlled by the binary number input on the lines 187–190.

Thus, the amount of force applied by the brake is controlled by lines 187 to 190 from PIA 178 which is in turn controlled by the machine's software. For the component values shown in the circuit of FIG. 12, the current supplied to brake unit 55 varies approximately 10 mA per step. If lines 187 to 190 are all logic "0's," there is no current supplied to the brake and if lines 187–190 are all logic "1's," 150 mA is supplied to the brake.

As mentioned, the machine's software controls the amount of force applied by the brake. The amount of force applied by the brake is determined by processing the information received from the beginning of stroke detector 130, the optical sensor 65 and the input control panel 29 as will be described in more detail below. The software also controls the video and sound processors to provide various visual and audio information to the user.

Figure 13A:
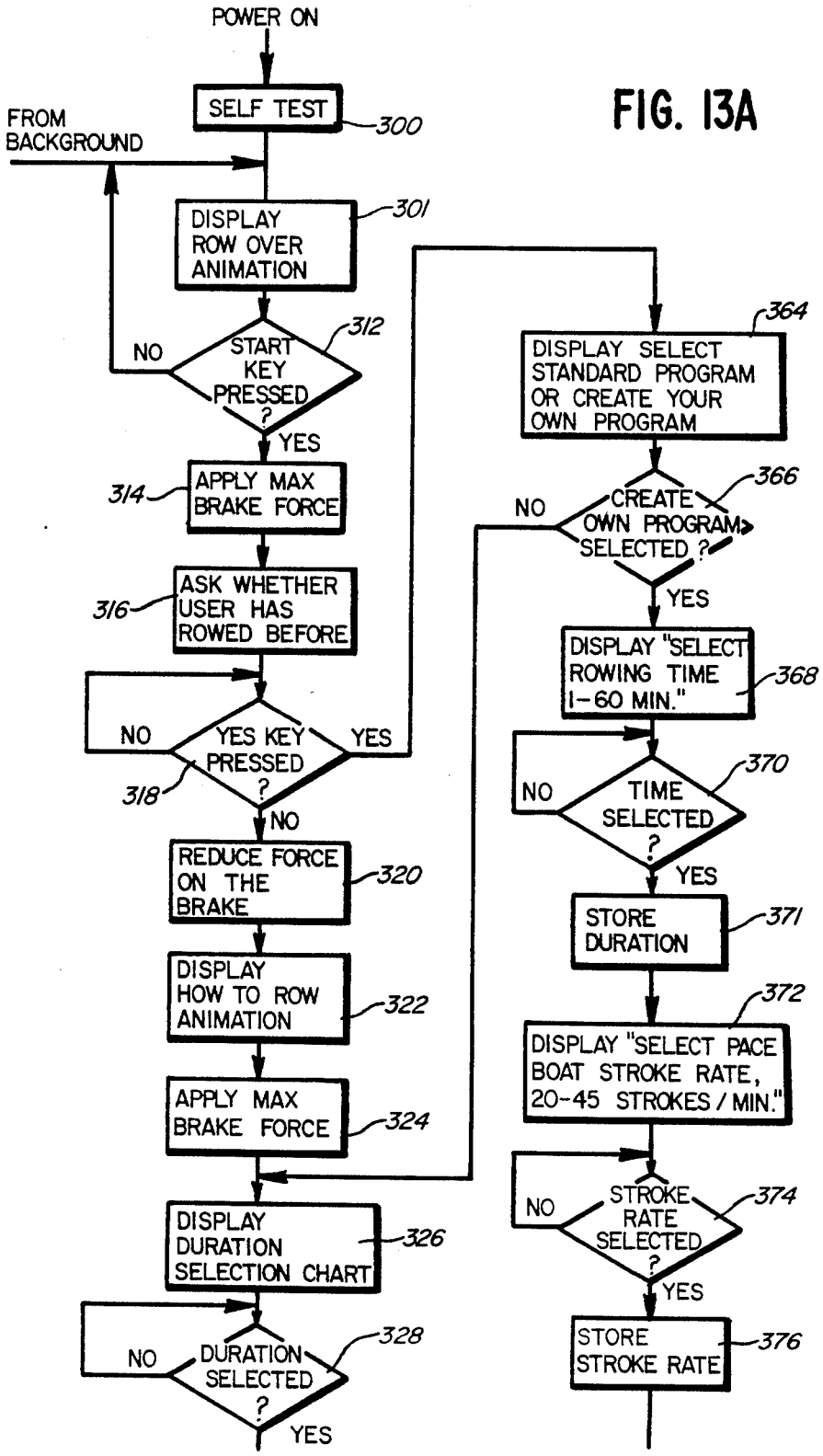
FIGS. 13A–B is a flowchart illustrating a portion of the computer control software for the rowing machine.
Figure 13B:
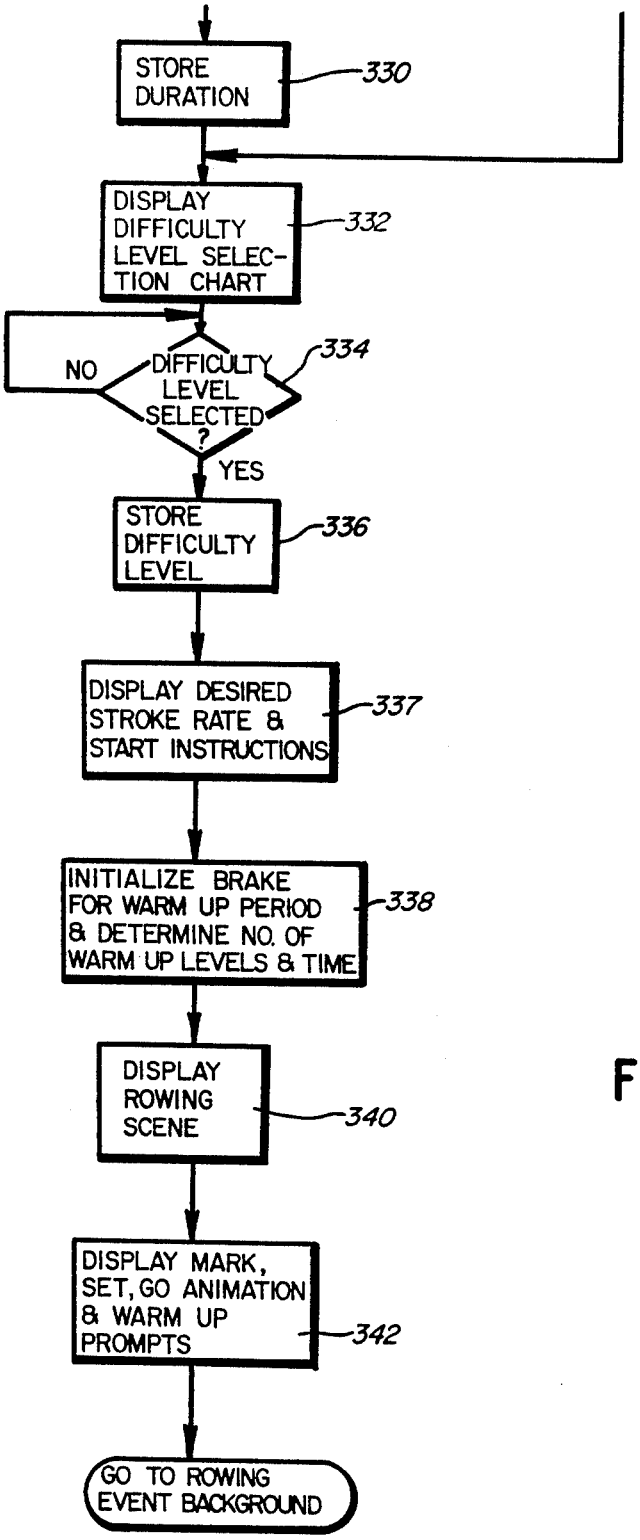

The microprocessor control of the rowing machine 20 will now be described with reference to the flowcharts shown in FIGS. 13 and 16–19. As shown in FIG. 13, when power is initially turned on for the rowing machine, a self-test routine is performed at block 300 by the microprocessor 140. During the self-test routine the processor's memories, including its RAM and ROM, its outputs and the video display, among other things, are tested to determine whether they are operational or not. Upon completing the self-test routine, the processor 140 at block 301 instructs the video display processor 144 to display "row over" animation which may include a title page and an honor roll listing the longest durations and highest difficulty levels achieved by the best users as previously recorded. The "row over" animation also includes "how to row" instructions which, as shown in FIGS. 14A–14D, depict the various positions a user of the rowing machine should assume during the power portion of a stroke.

The "how to row" instructions shown in FIGS. 14A–14D depict a user 302 sitting on a seat 304 of a rowing machine 305 with messages in a message block 303 instructing the user as to what he or she should be doing during each of the four parts of the power portion of a stroke. The power portion of a stroke begins from a starting position as shown in FIG. 14A in which the user 302 is depicted sitting upon the seat 304 with his feet strapped in the foot rests 307, his knees flexed and his arms extended while grasping the handle 35 which is pulled slightly out of the cable port in the cabinet 306. To instruct the user regarding the second part of the stroke's power portion, as shown in FIG. 14B, a message "START EXTENDING LEGS" is shown at block 303 while the user 302 is depicted with his legs partially extended; his arms fully extended with the cable further pulled out; and the seat 304 moved down the rail 308 in the direction away from the cabinet 306. To instruct the user regarding the third part of the stroke's power portion, as shown in FIG. 14C, a message "EXTEND LEGS; START PULLING WITH ARMS" is shown at block 303 while the user 302 is depicted with his legs fully extended and his arms flexed to indicate that he is pulling on the cable 36 with his arms. To instruct the user regarding the final part of the power portion of a stroke, as shown in FIG. 14D, a message "PULL ARMS TO CHEST" is shown at block 303 while the user 302 is depicted with his legs fully extended and his arms pulled in to his chest. At the end of the power portion of a stroke, the user flexes his knees and allows the cable 36 and rewind mechanism to pull him or her on the seat along the rail in the direction towards the cabinet where the user resumes the starting position as shown in FIG. 14A.

During the display of the "row over" animation as shown in FIGS. 14A–14D, a message is displayed on the monitor 28 at a block 310 instructing the user to press a start key to begin a rowing exercise in which the user selects the duration and difficulty level of the exercise and may even create his own program. At block 312, the microprocessor 140 determines whether the start key has been pressed and if it has not, the processor returns to block 301 to control the display of the "row over" animation. If the start key has been pressed, the microprocessor 140 instructs the brake control circuit 142 to apply a maximum brake force of 47 pounds to the brake unit 55. The maximum brake force is applied at block 314 to enable a user to hold the handle 35 for support while touching the keys on the input control panel 29. The maximum force of 47 pounds will maintain the handle 35 against the cable port 38 while a user is grasping the handle for support but is not pushing with his or her legs. This feature enables a relatively small person, whose arms might not otherwise reach the input control panel while in the starting position, to pull himself or herself forward, sliding the seat 23 towards the cabinet to allow the person to easily access the input control panel 29.

After applying maximum brake force at block 314, the microprocessor 140, at block 316, controls the video display processor 144 to display a query on the video display 28 asking the user whether he has rowed before. At block 318 the processor 140 determines whether the yes key has been pressed or not and if it has, the processor gives the user the option to create his own exercise program as discussed in detail below. If the user has not rowed before, the microprocessor 140, at block 320, reduces the force on the brake to 15.4 pounds so that a novice rower may pull the handle 35 away from the cabinet 27. At block 322, the "how to row" animation as discussed above with reference to FIGS. 14A–14B is displayed in response to a command from the processor 140. At this time, two sequences of rowing animation are depicted, the first sequence displays the four parts of the power portion of a stroke as depicted in FIGS. 14A–14D wherein the user is asked to merely watch how a proper stroke is performed. Thereafter, a second sequence of instructions, identical to the first sequence is displayed on the video monitor 28 along with a message instructing the user to join in and practice a stroke. Upon completely the how to row animation at block 322, the processor 140 at block 324 instructs the brake control circuit 142 to apply the maximum brake force of 47 pounds so that the user may once more use the handle 35 for support while making various selections on the input control panel 29.

The processor 140 at block 326 controls the video display processor 144 to display on the video monitor 28 a duration selection chart which allows a user to select one of six durations as follows: durations of 1 minute, 3 minutes or 6 minutes which are warm up durations; durations of 12 minutes and 15 minutes which are the durations for aerobic conditioning; and a 20 minute duration for advanced conditioning. After controlling the display of the duration selection chart at block 326, the microprocessor 140, at block 328, determines whether a duration has been selected by the user. When a duration has been selected, the processor 140 stores the selected duration at block 330. Thereafter, the processor 140 at block 332 controls the video display processor 144 to display on the video monitor 28 a difficulty level selection chart. The difficulty level selection chart enables a user to select difficulty levels from 1 to 15 as follows:

| Difficulty Level | Braking Force |
|---|---|
| 1 | 8.8 lbs. |
| 2 | 11.8 lbs. |
| 3 | 15.4 lbs. |
| 4 | 19 lbs. |
| 5 | 22.6 lbs. |
| 6 | 26.2 lbs. |
| 7 | 29.2 lbs. |

-continued

| Difficulty Level | Braking Force |
|---|---|
| 8 | 31.3 lbs. |
| 9 | 34 lbs. |
| 10 | 36.5 lbs. |
| 11 | 39 lbs. |
| 12 | 41.2 lbs. |
| 13 | 43.5 lbs. |
| 14 | 45.4 lbs. |
| 15 | 47 lbs. |

After controlling the display of the difficulty level selection chart at block 332, the processor 140, at block 334 determines whether the user has selected a difficulty level. After the user has selected a difficulty level, the processor 140 stores the selected level at a block 336. Next, the processor 140 at block 337 controls the video display processor 144 to display on the video monitor 28 the desired stroke rate for the selected difficulty level and start instructions such as "WAIT FOR GUN TO BEGIN."

At block 338, the processor 140 controls the brake control circuit 142 to initialize the brake 55 for a warm up period. Warm up occurs during the first thirty seconds of the selected exercise duration and starts with an initial brake force which is approximately 60% of the force associated with the selected difficulty level. The actual brake force applied is the force associated with the difficulty level which is equal to the integer portion of 60% of the selected difficulty level. During the thirty second warm up period, the processor 140 increases the force applied by the brake from the 60% starting level, in steps corresponding to the levels between the warm up starting level and the selected difficulty level. For example, if a user selects a difficulty level of 10 with an associated force of 36.5 lbs., the initial braking force applied will be 26.2 lbs. associated with the difficulty level 6 since 60% of 10 is 6. Thereafter, the processor will gradually increase the force from 26.2 lbs. going in steps through each of levels 7–9 until the 36.5 lb. force associated with level 10 is reached. In order to initialize the brake at block 338, the processor sets the brake to the approximately 60% level of the selected level. At block 338, the processor also calculates the number of warm up levels and the duration of each warm up level. The number of warm up levels is equal to the number associated with the selected level minus the number associated with the starting level. The duration of the starting level and each intermediate level is equal to the thirty second warm up period divided by the difference between the selected level and the starting level. In the above example, the duration of each warm up level is $30/(10-6)=7.5$ seconds.

A cool down period is also provided for 30 seconds after the exercise duration time has expired. During the cool down period, the brake force applied is gradually decreased to the approximately 60% level force initially applied during warm up. As similarly done in warm up, in cool down the brake force decreases in steps corresponding to the levels between the selected difficulty level and the approximately 60% level until the 60% level is reached.

Figure 15:
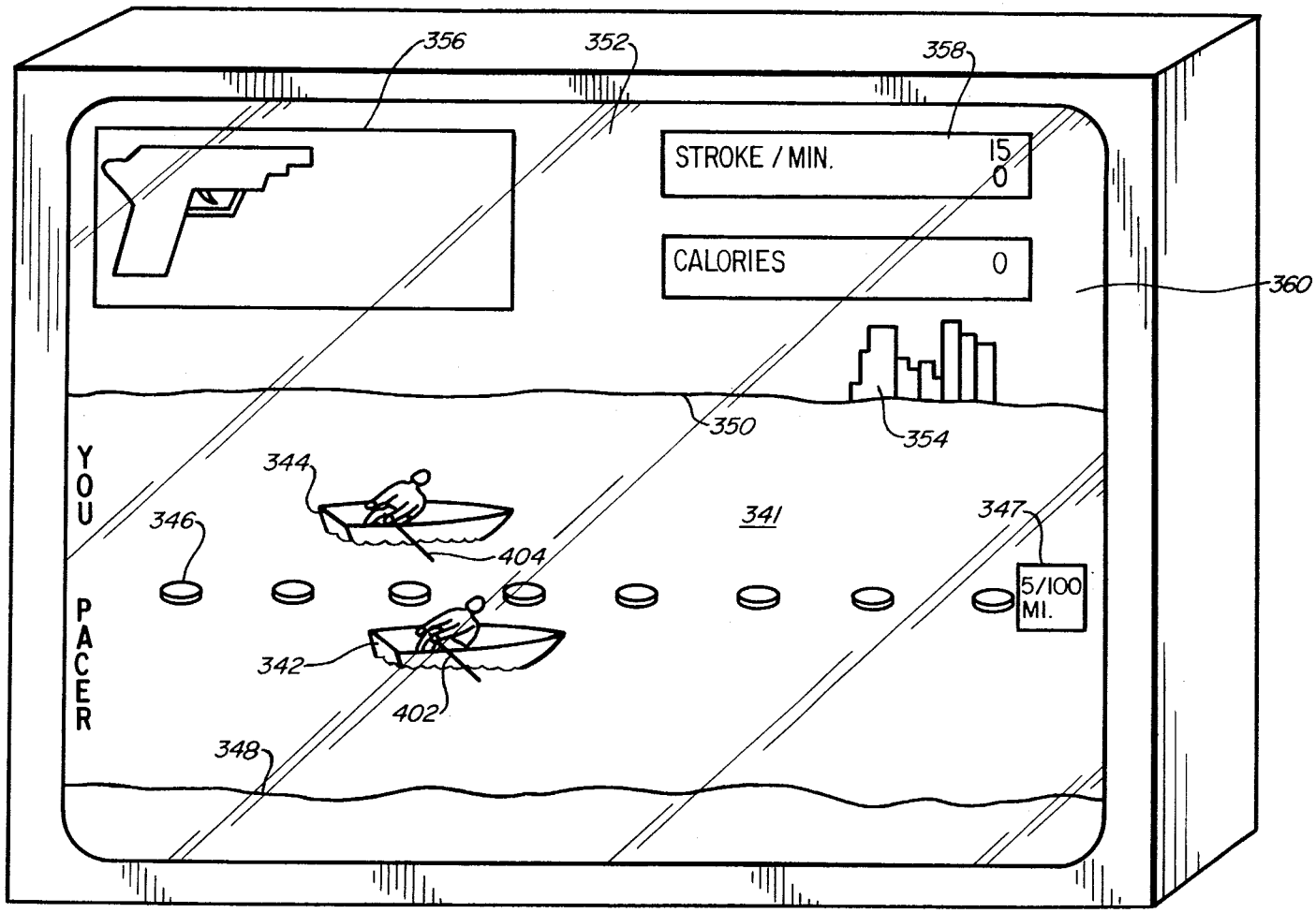
FIG. 15 is an illustration of a rowing scene displayed on the video display monitor of the rowing exercise machine.
Figure 16:
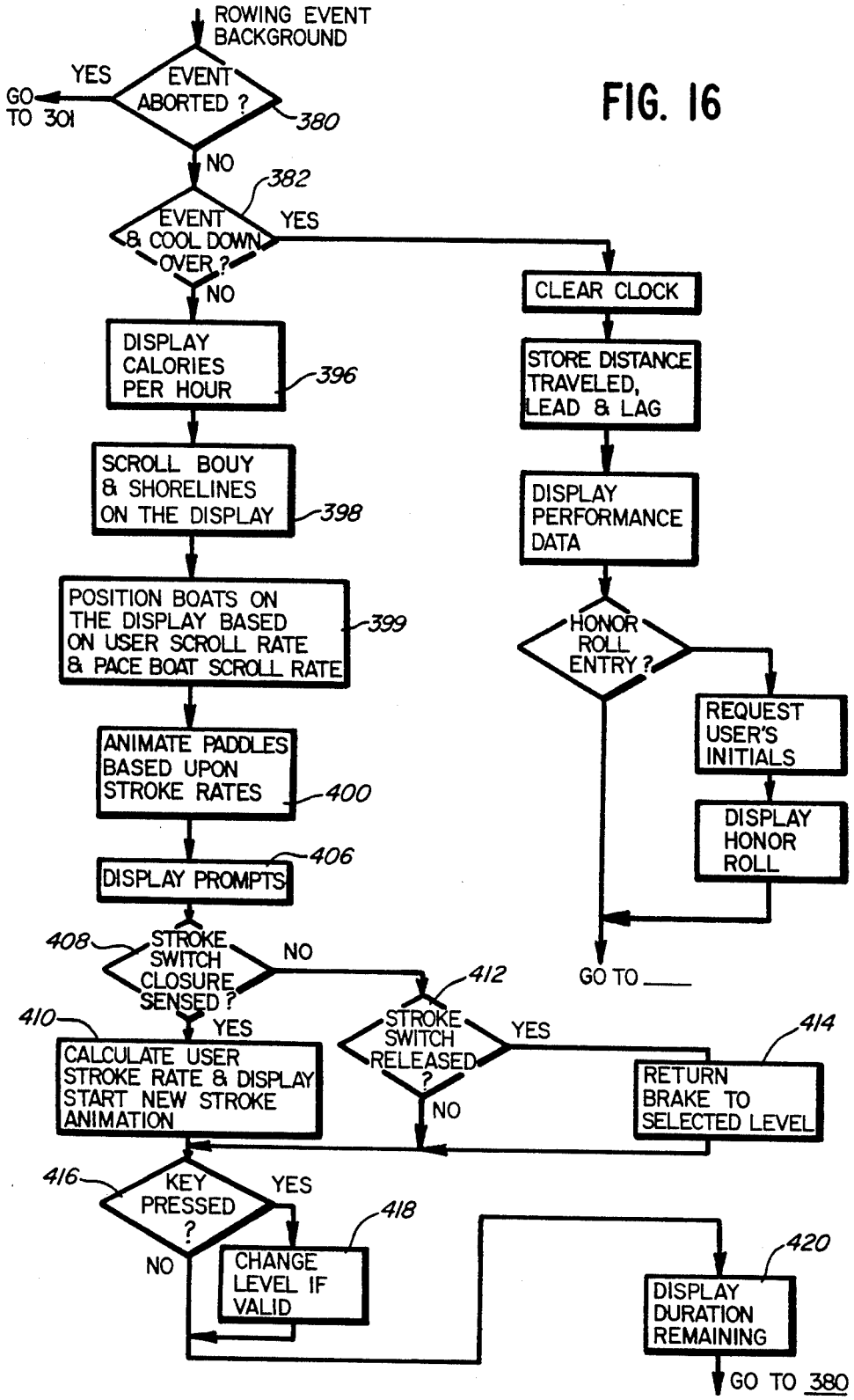
FIG. 16 illustrates the rowing event portion of the computer control software for the rowing machine.

After initializing the brake for the warm up period at block 338, the processor 104 at block 340 controls the video display processor 144 to display on the monitor 28 a rowing scene such as is depicted in FIG. 15. As illustrated in FIG. 15, the rowing scene shows a body of water 341 with two rowing FIGS. 342 and 344 on it. Across from the rowing Figure 344 is displayed the word "YOU" and across from rowing Figure 342 is displayed the word "PACER". A series of buoys 346 separate the rowing figures. Mileage signs 347 are displayed between buoys. A near shoreline 348, far shoreline 350, sky 352 and a city scape 354 are also depicted. Various prompting messages are shown in a message block 356 along with the rowing time which has elapsed since the start of the rowing exercise. A message block 358 shows the user's stroke rate and a message block 360 shows the number of calories the user is burning per hour rounded to the nearest hundred.

The sky 352, the body of water and the words "YOU" and "PACER" are part of the display's background and do not change throughout the rowing exercise. The data to display the two rowing Figures 342 and 344 is stored in several separate memory blocks in the ROMs 154 or 156. Each of the memory blocks displays the rowing figures in one of several rowing positions which when displayed one after the other result in an animation so that the figures appear to be rowing. The video processor 144 displays the rowing figures as foreground sprites so that the position (here only the horizontal position) of each is variable and controllable by software. The city scape 354 and the mileage signs 347 are also foreground sprites.

The buoys 346 are stored in twenty-four separate memory blocks in the ROMs 154 or 156. When displayed on the screen, each block is eight pixels high and twenty-four pixels long. Each of the twenty-four memory blocks stores the buoys in a slightly different location with respect to the start of the block. Thus, the blocks can be displayed one after the other so that the buoys appear to move on the screen. Several blocks are displayed end to end to substantially cover the length of the screen. The rate at which the buoys move across the screen, i.e. the scroll rate, is controlled by software as described below.

The shorelines 348 and 350 are each stored in memory blocks in the ROMs 154 or 156. When displayed on the screen, each block is eight pixels high and 256 pixels long. A pointer in the software controls which portion of the block appears on the left edge of the screen. Thus, as the pointer is incremented, the shorelines appear to move on the screen.

When the rowing Figures 342 and 344 are animated, and the buoys, shorelines, mileage signs and city scape are scrolled, the scene will appear to the viewer as though the figures are rowing down the body of water. Further, when the horizontal location of one of the rowing figures is changed with respect to the other figure, one of the figures will appear to be rowing faster than the other.

Returning to FIG. 13, the video display processor 144 is controlled by the processor 140 at block 342 to display on the monitor 28 an animation sequence with accompanying sounds to begin the rowing exercise. The animation sequence shows a starting gun while the sound processor 143 provides sounds of nautical bells and crowd cheers to signal to the user that the exercise is about to begin. The animation sequence follows with the starting gun being raised as starting commands, "MARK," "GET SET," "GO" are displayed. Simultaneously with the "GO" command, the starting gun is seen and heard to go off. The processor 140 then goes to the rowing event software depicted in FIG. 16.

As shown in FIG. 13, the "create your own program" option is provided to a user who has rowed before as determined at block 318. If the user has rowed before, at block 364, the processor 140 controls the video display processor 144 to display on the monitor 28 a message requesting the user to select the standard program discussed above or the "create your own program" option. If the user selects the "create your own program" option as determined by the processor at block 366, at block 368 the processor 140 controls the video display processor 144 to display on the monitor 28 a message requesting the user to select a rowing time which may be any whole number time between 1 and 60 minutes as his selected rowing exercise duration. When the user selects his rowing duration as determined by the processor at block 370, the processor stores the selected duration at block 371. At block 372, the processor 140 controls the video display processor 144 to display on the monitor 28 a message requesting the user to select the stroke rate of the pace boat which may be any whole number rate between 20 strokes per minute and 45 strokes per minute. When the pace boat stroke rate has been selected by the user as determined by the processor at block 140, the processor stores the stroke rate at block 376. Thereafter, the processor 140 returns to block 332 to allow the user to select one of the 15 standard difficulty levels. The "create your own program" option as illustrated in FIG. 13 allows a user to create a program suited to his particular needs very easily by making two input selections normally not available during the standard program.

Figures 17, 19:
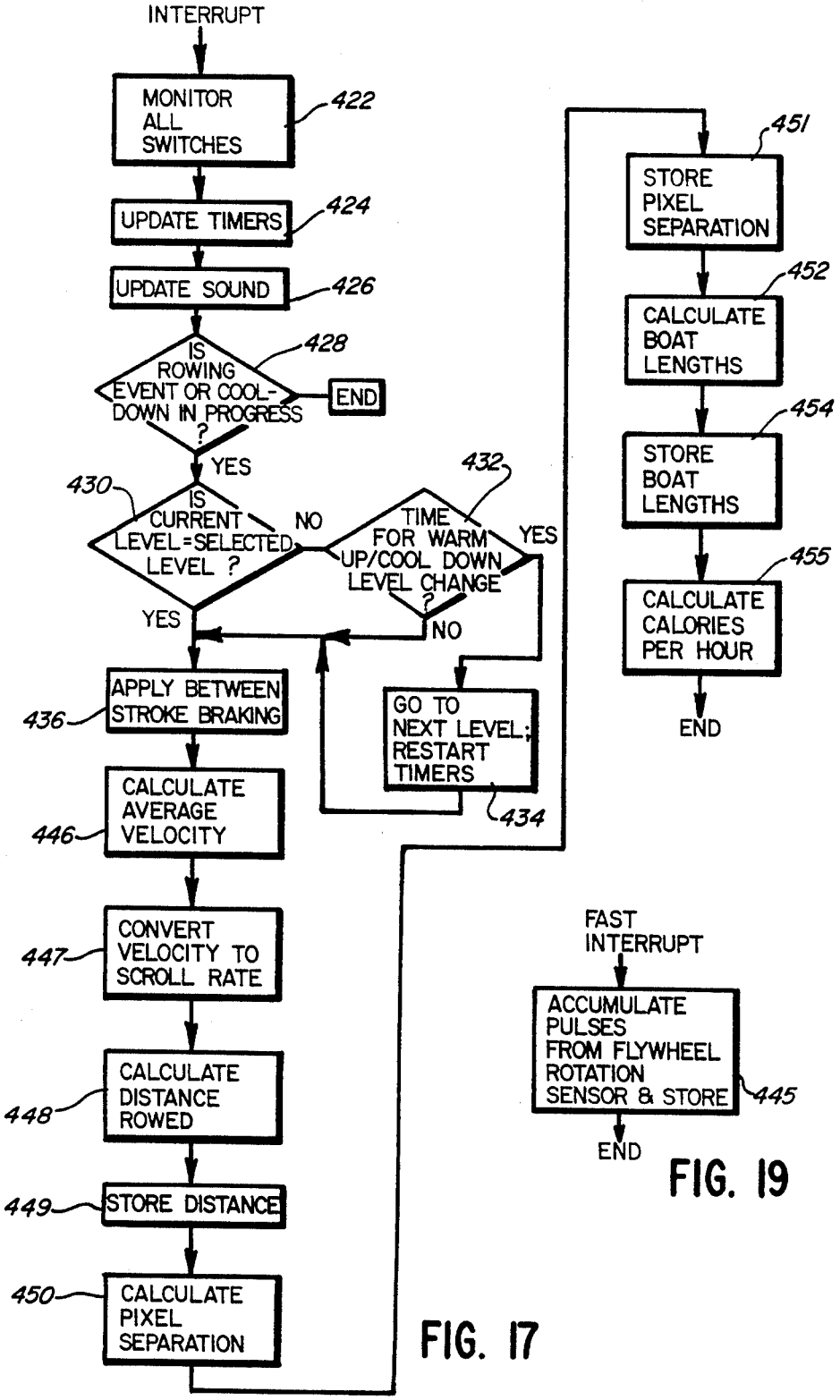
FIG. 17 is a flowchart illustrating an interrupt routine for the computer control system of the rowing machine.
FIG. 19 is a flowchart illustrating a fast interrupt routine for the computer control system of the rowing machine.

The rowing event software routine is background, which runs continuously but is periodically interrupted by the interrupt routines illustrated in FIGS. 17 and 19. At block 380 of the rowing event routine, the processor 140 determines whether the rowing "event," i.e. the exercise, has been aborted. The exercise may be aborted by a user by pressing the start key a second time. If the rowing event has been aborted as determined at block 380, the processor returns to block 301 of FIG. 13. If the rowing event has not been aborted, the processor determines, at block 382 whether the rowing event and cool down periods are over. If they are, the processor clears its clock at block 384. At block 386 the processor stores the distance travelled by the user and the user's lead or lag with respect to the pace boat. The processor 140 then controls the video display processor 144 to display on the video monitor 28, the user's performance data which includes the distance he or she has travelled during the rowing exercise, the total calories he or she has burned, and the duration and level of difficulty of the exercise. The processor 140, at block 390, determines whether the user's performance was good enough to enter the user on the honor roll and if so, at block 392 controls the video monitor 28 through the processor 144 to display a message requesting the user's initials. Thereafter, at block 394, the processor 140 controls the video monitor 28 to display the honor roll listing the user's performance. From blocks 390 or 394 the processor 140 returns to block 301 shown in FIG. 13.

If the rowing event and cool down period are not over as determined at block 382 by the processor 140, the processor at block 396 controls the video display processor 144 to display on the video monitor 28 the calories burned by the user per hour rounded to the nearest hundred. At block 398, the processor 140 controls the video display processor 144 to scroll the buoys 346 and the shorelines 348 and 350 on the display. The processor 140, at block 399 controls the video display processor 144 to position the boats on the video display monitor screen based on the user's scroll rate and pace boat's scroll rate as determined during the interrupt routine illustrated in FIG. 17 discussed below. Thereafter, at block 400, the paddles 402 and 404 of the pace boat and user's boat on the display are animated based upon the stroke rates, the stroke rate for the pace boat being fixed. At block 406, the processor 140 controls the video display processor to display prompt messages at block 356 on the display. Such prompt messages may include the following: "warm up," "cool down," "pull through entire stroke," "use your legs," "keep ahead of the pace boat," "keep your back straight," etc. The processor, at block 408, determines whether the beginning of stroke switch closure has been sensed and if it has, the processor 140 calculates the user's stroke rate at block 410 based on the time which has elapsed between successive switch closures of the beginning of stroke switch 110. At block 410, the processor also controls the video display processor 144 to display the start new stroke animation. If the processor 140 determines, at block 408, that closure of the beginning of stroke switch is not sensed, the processor, at block 412 determines whether the stroke switch has been released. If the stroke switch has been released, the processor 140 controls the brake control circuit 142 to return the brake force to the level selected by the user. Thereafter, the processor 140, at block 416 determines whether a key on the input control panel has been pressed in order to change the difficulty level. If a valid difficulty level key has been pressed, the processor changes the difficulty level at block 418 and thereafter, at block 420, controls the video display processor 144 to display on the video monitor 28 the duration remaining in the rowing exercise. From block 420, the processor 140 returns to block 380.

During the interrupt routine, as shown in FIG. 17, the processor 140, at block 422, monitors the rowing machine input switches. The switches include the keys on the user input control panel 29 as well as the beginning of stroke switch 110. The processor 140 at block 424 updates the system's timers. Next, at block 426 the processor 140 controls the sound processor 143 to update the sound emanating from the speaker 30 such as the sound of the user's oar as it hits the water as depicted in the rowing scene. At block 428, the processor 140 determines whether the rowing event or cool down are in progress and if not the interrupt routine ends. If the rowing event or cool down is in progress, the processor at block 430 determines whether the current difficulty level is equal to the selected level. If the current level is not equal to the selected difficulty level, either a warm up or cool down period is in progress. The processor at block 432 determines whether it is time for the next increasing warm up level or decreasing cool down level and if it is, controls the brake force to be incremented to the next difficulty level with the warm up/cool down timer being restarted at block 434. Thereafter, the processor 140 at block 436 applies a between stroke braking force as illustrated in FIG. 18.

Figure 18:
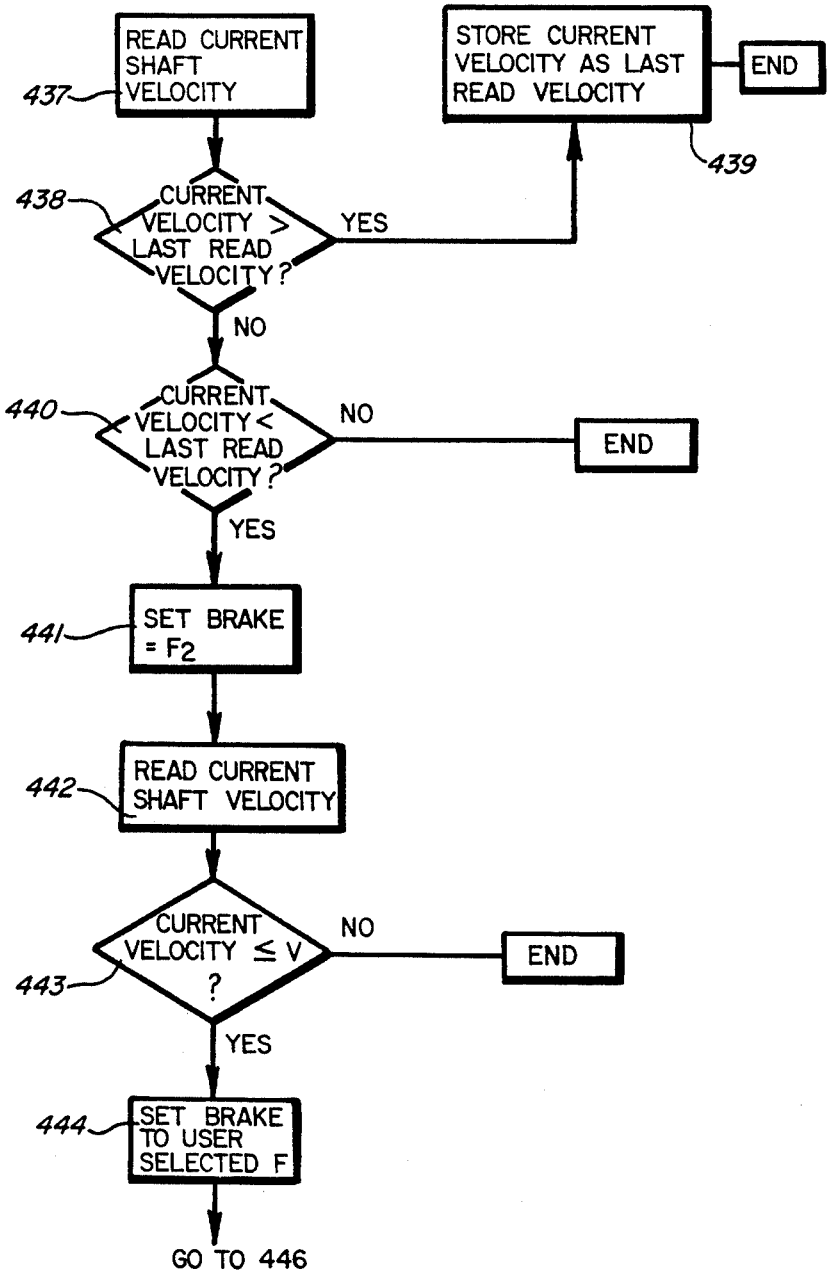
FIG. 18 is a flowchart illustrating a portion of the interrupt routine of FIG. 17.

As shown in FIG. 18, to apply the between stroke braking, the processor 140 at block 437 determines the current velocity of the master shaft 43. At block 438 the processor determines whether the current velocity of the master shaft is greater than the last read velocity and if so, the processor stores the current velocity as the last read velocity at block 439 and returns to the interrupt routine shown in FIG. 17. If the current velocity is less than or equal to the last read velocity, at block 440, the processor 140 determines whether the current velocity is less than 80% of the last read velocity to in turn determine whether the power portion of the stroke has been completed. If it is not, the processor 140 returns to the interrupt routine. If the current velocity is less than 80% of the last read velocity, the processor 140 at block 441 controls the brake control circuit 142 to apply the maximum brake force of 47 pounds to stop or essentially stop the flywheel. At block 442, the processor reads the current velocity of the master shaft 43 and at block 443 determines whether the current velocity is less than or equal to a minimum velocity close zero. If it is not, the processor 140 returns to the interrupt routine and if it is, the processor 140, at block 444, controls the brake control circuit 142 to apply the brake force selected by the user. Thereafter, the processor 140 returns to the interrupt routine at block 446.

The processor 140, at block 446 of the interrupt routine calculates the average velocity of the user based on the number of pulses accumulated from the optical detecting device 60 as determined at block 445 during a fast interrupt routine shown in FIG. 19. The fast interrupt routine is run every time the processor 140 senses a pulse from the optical detecting device 60 to accumulate and store the pulses from the device. At block 447 in the interrupt routine, the processor converts the average velocity calculated at block 446 to a scroll rate and at block 448 calculates the distance rowed by the user. The processor, at block 449, stores the user's distance value determined at block 448. It is noted that the distance travelled by the pace boat is equal to the speed of the pace boat (which is a constant dependent upon the difficulty level selected by the user) times the elapsed time measured from the start of the rowing exercise. The number of pixels which should separate the rowing figures 342 and 344 is calculated at block 450 by the processor 140 to enable the video display processor 144 to update the video monitor 28. The calculated pixel separation is stored by the processor 140 at block 451 and at block 452 the processor calculates the number of boat lengths separating the user rowing figure and the pacer, the processor storing the calculated boat lengths at block 454. At block 455, the processor 140 calculates the calories per hour, rounded to the nearest hundred to complete the interrupt routine.

We claim:

1. In a rowing exercise machine having a user interface means with a cable for accepting user exercising stroke movements, each stroke having a power and return portion, the machine further having a shaft, a cable drum carried on the shaft and adapted to have the cable unwound therefrom and rewound thereon to impart rotation to the shaft and to a flywheel connected to the shaft for receiving and conserving angular momentum imparted thereto, and means for opposing the rotational displacement of said flywheel, an improved user interface comprising:

a strain relief spring;

a stainless steel eye staked into one end of said spring, an end of said cable being staked into the opposite end of said spring;

a handle secured to said eye;

a cable port through which said cable extends from the drum to the handle, said cable port is made of nylon; said cable port also has a centrally located aperture therein with cross sections which are generally oval in shape to allow the cable to be pulled out from said port along a line generally parallel to the base or at an upward angle with respect to said line without rubbing against said port; said aperture has a sidewall a first portion of which lies in a first plane generally parallel to said base and a second portion which lies in a second plane at an angle with respect to said first plane wherein said first aperture sidewall portion guides the cable strait out of said cable port along said line and said second aperture sidewall portion guides the cable out of the port at an upward angle.

2. The rowing machine of claim 1 wherein said energy converting means is housed in a cabinet.

3. In a rowing exercise machine having a user interface means with a cable for accepting user exercising stroke movements, each stroke having a power and return portion, the machine further having a shaft, a cable drum carried on the shaft and housed in a cabinet, said drum being adapted to have the cable unwound therefrom and rewound thereon to impart rotation to the shaft and to a flywheel connected to the shaft for receiving and conserving angular momentum imparted thereto, and means for opposing the rotational displacement of said flywheel, an improved cable port on said cabinet through which said cable extends from the drum to the handle disposed on the outside of said cabinet, the cable port having the general shape of a truncated pyramid with its base secured to the cabinet and its top having a centrally located aperture therein with cross sections which are generally oval in shape but of varying circumference, said aperture having sidewall portions positioned in planes with respect to the cabinet base to guide the cable out of the port along a line generally parallel to the base of the cabinet or at an upward angle with respect to said line.

4. The rowing machine of claim 3 wherein said cable port is made of nylon.

5. The rowing machine of claim 3 wherein said drum has a pair of end plates and a sidewall disposed there between, the sidewall being angled with respect to a line perpendicular to the end plates such that the circumference of the drum adjacent one end plate is less than the circumference of the drum adjacent the opposite end.

6. The rowing machine of claim 5 wherein said drum is provided with a nylon plate positioned between said end plates so as to lightly rub against the cable and guide it onto the drum.

7. In a rowing exercise machine having a user interface means with a cable for accepting user exercising stroke movements, each stroke having a power and return portion, the machine further having a shaft, a cable drum carried on the shaft and adapted to have the cable unwound therefrom and rewound thereon to impart rotation to the shaft and to a flywheel connected to the shaft for receiving and conserving angular momentum imparted thereto, and means for opposing the rotational displacement of said flywheel, an improved cable drum comprising a pair of end plates and a sidewall positioned therebetween wherein said sidewall is angled with respect to a line perpendicular to said end plates such that the circumference of the drum adjacent one end plate is less than the circumference of the drum adjacent the opposite end plate.

8. The rowing machine of claim 7 further including a guide plate positioned between said end plates so as to lightly rub against the cable and guide it onto the drum.

* * * * *